US011196199B2

(12) United States Patent
Nakamura

(10) Patent No.: US 11,196,199 B2
(45) Date of Patent: Dec. 7, 2021

(54) CONNECTOR INCLUDING HOLDING MEMBER FOR HOLDING CONDUCTIVE MEMBER

(71) Applicant: HIROSE ELECTRIC CO., LTD., Kanagawa (JP)

(72) Inventor: Koichi Nakamura, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/038,505

(22) Filed: Sep. 30, 2020

(65) Prior Publication Data

US 2021/0104832 A1 Apr. 8, 2021

(30) Foreign Application Priority Data

Oct. 8, 2019 (JP) ..... JP2019-185096

(51) Int. Cl.
*H01R 12/70* (2011.01)
*H01R 12/77* (2011.01)
*H01R 12/79* (2011.01)

(52) U.S. Cl.
CPC ..... *H01R 12/774* (2013.01); *H01R 12/79* (2013.01)

(58) Field of Classification Search
CPC ..... H01R 12/774; H01R 12/79
See application file for complete search history.

(56) References Cited

U.S. PATENT DOCUMENTS 5,385,478 A * 1/1995 Niekawa ..... H01H 1/36 439/347
5,735,709 A * 4/1998 Hashiguchi ..... H01R 12/79 439/260

(Continued)

FOREIGN PATENT DOCUMENTS

JP 6040333 B1 12/2016

*Primary Examiner* — Neil Abrams
(74) *Attorney, Agent, or Firm* — Rankin, Hill & Clark LLP

(57) ABSTRACT

A connector includes a housing, and a holding member attached to the housing. The holding member holds a stack of a first conductive member and a first reinforcing plate. The first reinforcing plate is disposed on a second face of the first conductive member, the second face being opposite to a first face on which a plurality of conductors is arranged adjacent to each other in a width direction and planarly exposed at a first end side in a length direction. The holding member is laid in a band shape in the width direction on the stack at an intermediate position between the first end side and a second end side in the length direction. The stack further includes a second reinforcing plate and a second conductive member. The second reinforcing plate is disposed on a second face of the first reinforcing plate, the second face being opposite to a first face on which the first conductive member is disposed. The second conductive member is disposed on a second face of the second reinforcing plate, the second face being opposite to a first face on which the first reinforcing plate is disposed. The second reinforcing plate is disposed on a second face of the second conductive member, the second face being opposite to a first face on which a plurality of conductors is arranged adjacent to each other in the width direction and planarly exposed at the first end side in the length direction.

16 Claims, 18 Drawing Sheets

(56) References Cited

U.S. PATENT DOCUMENTS

| | | | | |
|---|---|---|---|---|
| 6,520,797 | B2 * | 2/2003 | Okamura | H01R 12/78 439/495 |
| 6,558,186 | B1 * | 5/2003 | LePottier | H01R 12/79 439/496 |
| 7,189,105 | B2 * | 3/2007 | Takaku | H01R 12/592 439/497 |
| 7,625,231 | B2 * | 12/2009 | Takahira | H01R 12/79 439/260 |
| 8,435,059 | B2 * | 5/2013 | Honda | H01R 12/88 439/260 |
| 8,662,916 | B2 * | 3/2014 | Ashibu | H01R 12/88 439/495 |
| 8,858,249 | B2 * | 10/2014 | Honda | H01R 12/88 439/260 |
| 8,926,339 | B2 * | 1/2015 | Houtz | H01R 13/5045 439/76.1 |
| 9,590,337 | B2 * | 3/2017 | Annis | H01R 12/79 |
| 9,673,546 | B2 * | 6/2017 | Okura | H01R 12/774 |
| 10,135,161 | B2 * | 11/2018 | Sunada | H01R 13/6275 |
| 10,193,255 | B2 * | 1/2019 | Ito | H01R 12/87 |
| 10,879,634 | B1 * | 12/2020 | Liao | H01R 12/77 |
| 10,897,098 | B2 * | 1/2021 | Suda | H01R 13/6585 |
| 2017/0373414 | A1 | 12/2017 | Sunada | |
| 2021/0104832 | A1 * | 4/2021 | Nakamura | H01R 12/774 |
| 2021/0104836 | A1 * | 4/2021 | Nakamura | H01R 12/724 |
| 2021/0249803 | A1 * | 8/2021 | Kojima | H01B 7/0861 |

* cited by examiner

CONNECTOR INCLUDING HOLDING MEMBER FOR HOLDING CONDUCTIVE MEMBER

CROSS-REFERENCE TO RELATED APPLICATION

This application claims priority from Japanese Patent Application No. 2019-185096 filed with the Japan Patent Office on Oct. 8, 2019, the entire content of which is hereby incorporated by reference.

BACKGROUND

1. Technical Field

The present disclosure relates to a connector including a holding member for holding a conductive member, a counterpart connector usable with the connector, and a connector device including the connector and the counterpart connector.

2. Related Art

Japanese Patent No. 6040333 discloses a connector of the above type, a counterpart connector, and a connector device, that is, an electrical connection device. The electrical connection device is configured as a device that electrically connects a conductive member and a substrate to each other. The electrical connection device includes a first connector and a second connector as a counterpart connector connectable with the first connector.

The conductive member to be connected to the first connector includes a plurality of conductors and is configured as a flexible cable or flexible board including a plurality of insulation-covered conductors. The conductive member includes the plurality of conductors, a covering portion, and a reinforcing plate.

The reinforcing plate is a member that is disposed in an end portion of the conductive member so that a process of connecting the end portion of the conductive member to the first connector is smoothly performed. The reinforcing plate is fixed by being stuck to one of the front and back faces at a leading end of the end portion of the conductive member. The conductive member includes, in the end portion thereof, a conductor-exposing portion in which ends of the plurality of conductors are exposed. The conductor-exposing portion is provided as a portion for exposing the ends of the plurality of conductors in one of the flatly-expanding front and back faces at the side opposite to the side where the reinforcing plate is attached.

The first connector includes a conductive member attaching portion and a holder portion. The conductive member attaching portion is attached to the end portion of the conductive member by inserting the end portion of the conductive member into the conductive member attaching portion in a connection direction that is a direction perpendicular to the thickness direction and the width direction.

When the end portion of the conductive member is attached to the conductive member attaching portion, the end portion of the conductive member is inserted into an insertion slot of a tubular portion from the side opposite to the leading end side of the conductive member attaching portion and sandwiched between a rib and a center holding portion. Moreover, in a state where the end portion of the conductive member is attached to the conductive member attaching portion, the periphery of the end portion of the conductive memberis circumferentially covered and enclosed by the tubular portion of the conductive member attaching portion. More specifically, a part of the end portion of the conductive member, the part being adjacent to the conductor-exposing portion in the longitudinal direction of the conductive member, is covered and enclosed by the tubular portion.

When the first connector and the conductive member are connected to each other, the end portion of the conductive member is first inserted into the holder portion, and the conductive member attaching portion is then attached to the end portion of the conductive member inserted in an insertion hole of the holder portion. The conductive member attaching portion is fitted into and thus connected to the holder portion with the conductive member inserted in the insertion hole and with the conductive member attaching portion attached to the end portion of the conductive member.

SUMMARY

A connector according to an embodiment of the invention includes a housing, and a holding member attached to the housing. The holding member holds a stack of a first conductive member and a first reinforcing plate. The first reinforcing plate is disposed on a second face of the first conductive member, the second face being opposite to a first face on which a plurality of conductors is arranged adjacent to each other in a width direction and planarly exposed at a first end side in a length direction. The holding member is laid in a band shape in the width direction on the stack at an intermediate position between the first end side and a second end side in the length direction. The stack further includes a second reinforcing plate and a second conductive member. The second reinforcing plate is disposed on a second face of the first reinforcing plate, the second face being opposite to a first face on which the first conductive member is disposed. The second conductive member is disposed on a second face of the second reinforcing plate, the second face being opposite to a first face on which the first reinforcing plate is disposed. The second reinforcing plate is disposed on a second face of the second conductive member, the second face being opposite to a first face on which a plurality of conductors is arranged adjacent to each other in the width direction and planarly exposed at the first end side in the length direction.

DETAILED DESCRIPTION

Figure 1:
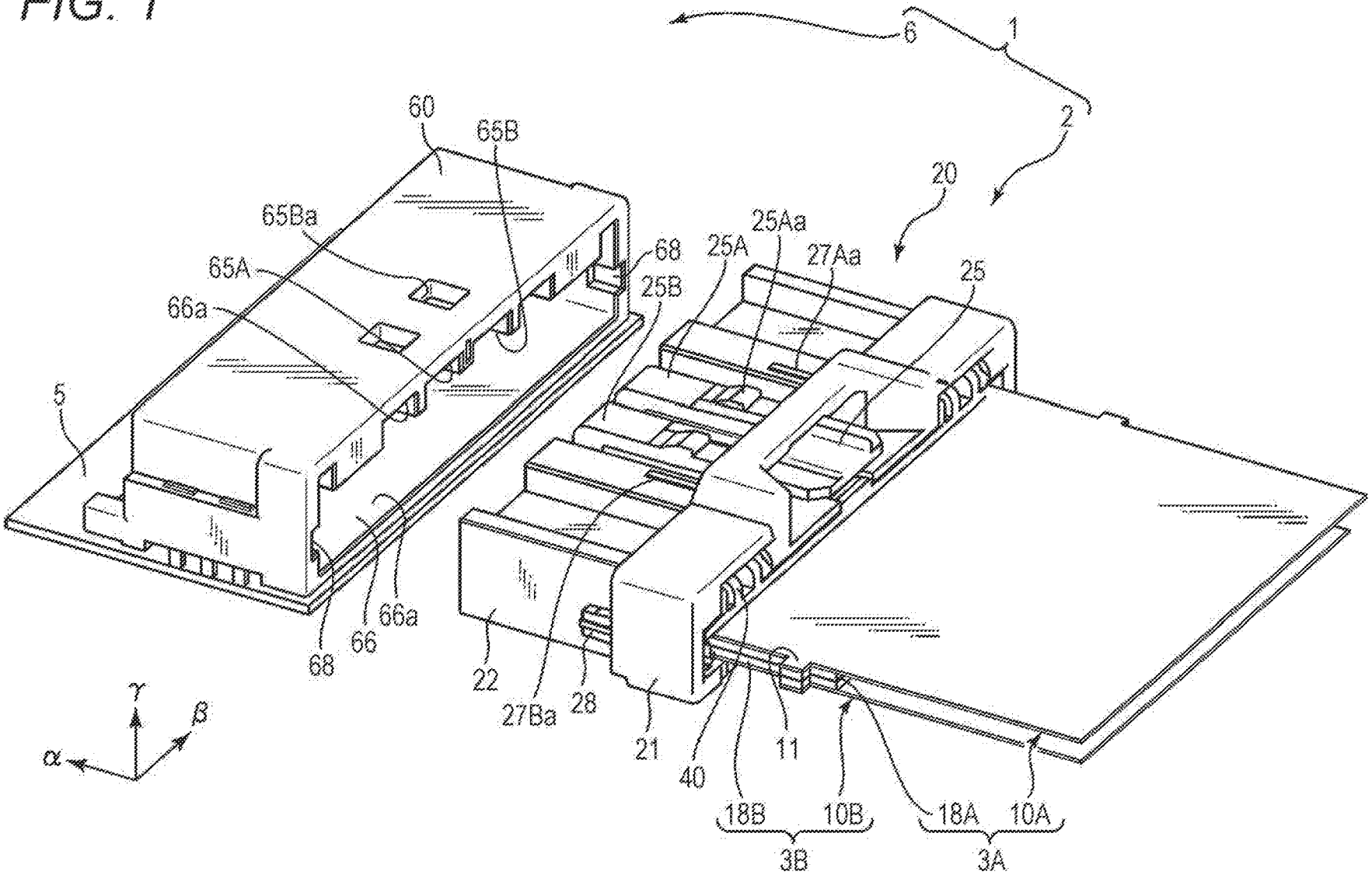
FIG. 1 is a perspective view illustrating a connector device according to a preferred embodiment of the invention, together with peripheral members.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the known connector described above, the end portion of the conductive member is attached to the conductive member attaching portion with the entire end portion circumferentially covered and enclosed by the tubular portion of the conductive member attaching portion. Thus, the attaching operation is complicated, and an attaching member is upsized.

Moreover, when the first connector and the conductive member are connected to each other, the end portion of the conductive member is first inserted into the holder portion, and the conductive member attaching portion is then attached to the end portion of the conductive member inserted in the insertion hole of the holder portion. The conductive member attaching portion is fitted into and thus connected to the holder portion with the conductive member inserted in the insertion hole and with the conductive member attaching portion attached to the end portion of the conductive member. Thus, the connecting operation is considerably complicated.

The present disclosure has been made to solve the problems in the related art, and an object thereof is to facilitate, in a connector including a holding member for holding a conductive member, an operation of attaching the conductive member and downsize a device.

In order to solve the above problems, a connector according to an embodiment of the invention includes a housing, and a holding member attached to the housing. The holding member holds a stack of a first conductive member and a first reinforcing plate. The first reinforcing plate is disposed on a second face of the first conductive member, the second face being opposite to a first face on which a plurality of conductors is arranged adjacent to each other in a width direction and planarly exposed at a first end side in a length direction. The holding member is laid in a hand shape in the width direction on the stack at an intermediate position between the first end side and a second end side in the length direction. The stack further includes a second reinforcing plate and a second conductive member. The second reinforcing plate is disposed on a second face of the first reinforcing plate, the second face being opposite to a first face on which the first conductive member is disposed. The second conductive member is disposed on a second face of the second reinforcing plate, the second face being opposite to a first face on which the first reinforcing plate is disposed. The second reinforcing plate is disposed on a second face of the second conductive member, the second face being opposite to a first face on which a plurality of conductors is arranged adjacent to each other in the width direction and planarly exposed at the first end side in the length direction.

According to the connector of the above embodiment, the holding member is laid in a band shape in the width direction on the stack including the conductive member at the intermediate position between the first end side and the second end side in the length direction. Thus, it is possible to simplify the conductive member attaching operation and downsize the device. Moreover, in the connector, electrical connection can be performed on both faces of a combined body of two stacks.

In the connector according to the above embodiment, the stack may include a locking projection on an end in the width direction, the locking projection projecting outward in the width direction. The holding member may include a locking portion configured to lock the locking projection.

In the connector according to the above embodiment, when the holding member holds the stack, the holding member may be continuously laid in a band shape in the width direction on only either a first face or a second face of the stack, or continuously laid in a band shape in the width direction on both the first face and the second face of the stack.

In the connector according to the above embodiment, when the holding member is attached to the housing, the holding member may be substantially entirely housed in a housing space of the housing in the length direction.

In the connector according to the above embodiment, when the holding member holding the stack is attached to the housing, a first portion of the first conductive member, the first portion being held by the holding member, and a second portion of the first conductive member, the second portion being located at the first end side in the length direction relative to the first portion held by the holding member may be housed in a housing space of the housing.

In the connector according to the above embodiment, the first reinforcing plate may be disposed in a first portion of the first conductive member, the first portion being held by the holding member, and a second portion of the first conductive member, the second portion being located at the first end side in the length direction relative to the first portion held by the holding member.

In the connector according to the above embodiment, the first reinforcing plate may not be disposed in a third portion of the first conductive member, the third portion being located at the second end side in the length direction relative to the first portion held by the holding member.

In the connector according to the above embodiment, a direction of connecting the connector to a counterpart connector may be identical to a direction of housing the holding member into a housing space of the housing.

In the connector according to the above embodiment, the housing insertable into an insertion space of a counterpart connector may include an abutment portion on an outer wall of the housing, the abutment portion projecting toward an inner wall of the insertion space and abuttable against the inner wall of the insertion space when at least a part of the housing is inserted into the insertion space.

In the connector according to the above embodiment, the abutment portion may include a set of a first abutment portion disposed on a first face of the outer wall of the housing and a second abutment portion disposed on a second face of the outer wall of the housing. The first abutment portion and the second abutment portion may be opposed to each other in a thickness direction perpendicular to both the width direction and the length direction and disposed at a substantially identical position in the length direction and the width direction.

In the connector according to the above embodiment, a counterpart connector connectable with the connector may include a plurality of counterpart terminals arranged adjacent to each other in the width direction, and a counterpart housing integrally molded with the counterpart terminals. Each of the counterpart terminals may include an elastic contact surface elastically contactable with a corresponding one of the conductors of the first conductive member in the length direction when the housing of the connector is inserted into an insertion space of the counterpart housing of the counterpart connector. The elastic contact surface may be bent in any direction intersecting the length direction in a portion contactable with the corresponding conductor of the first conductive member of the connector.

In the connector according to the above embodiment, the elastic contact surface is preferably bent in the thickness direction.

In the connector according to the above embodiment, the counterpart terminals may be arranged in stages in the thickness direction. The counterpart terminals may include first counterpart terminals and second counterpart terminals, the first counterpart terminals being arranged in a first stage and included in a first terminal group, the second counterpart terminals being arranged in a second stage and included in a second terminal group. The first counterpart terminals and the second counterpart terminals may be mutually displaced in the width direction and may have substantially no overlap in the thickness direction.

According to the embodiment of the invention, it is possible to facilitate, in a connector including a holding member for holding a conductive member, an operation of attaching the conductive member and downsize a device.

Hereinbelow, an exemplary embodiment of the invention will be described with reference to the accompanying drawings. For convenience of description, only a preferred embodiment is described. However, it is needless to say that the present disclosure is not limited to the preferred embodiment.

Figure 2:
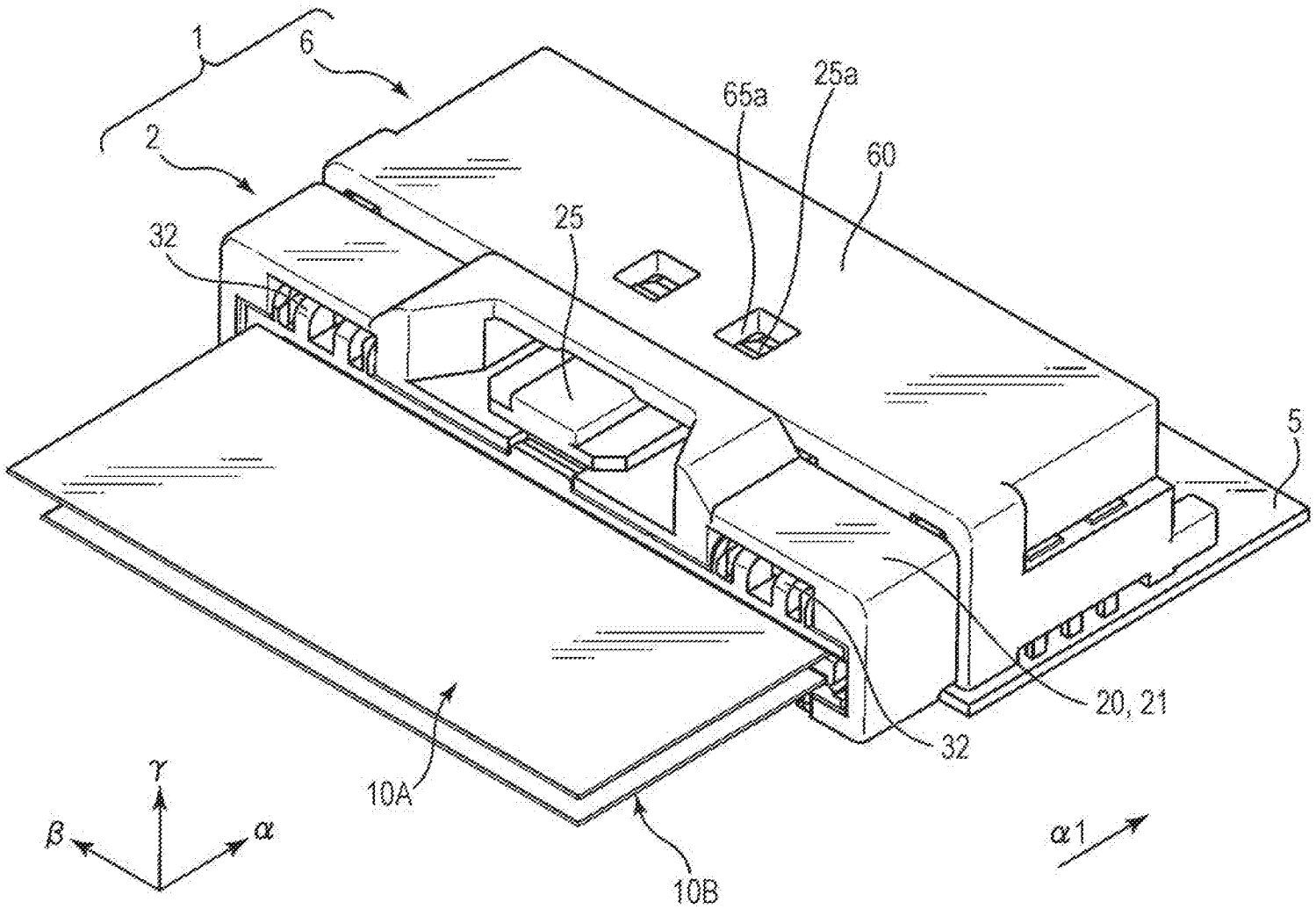
FIG. 2 is a perspective view illustrating a state after a connector and a counterpart connector are connected to each other.
Figure 3:
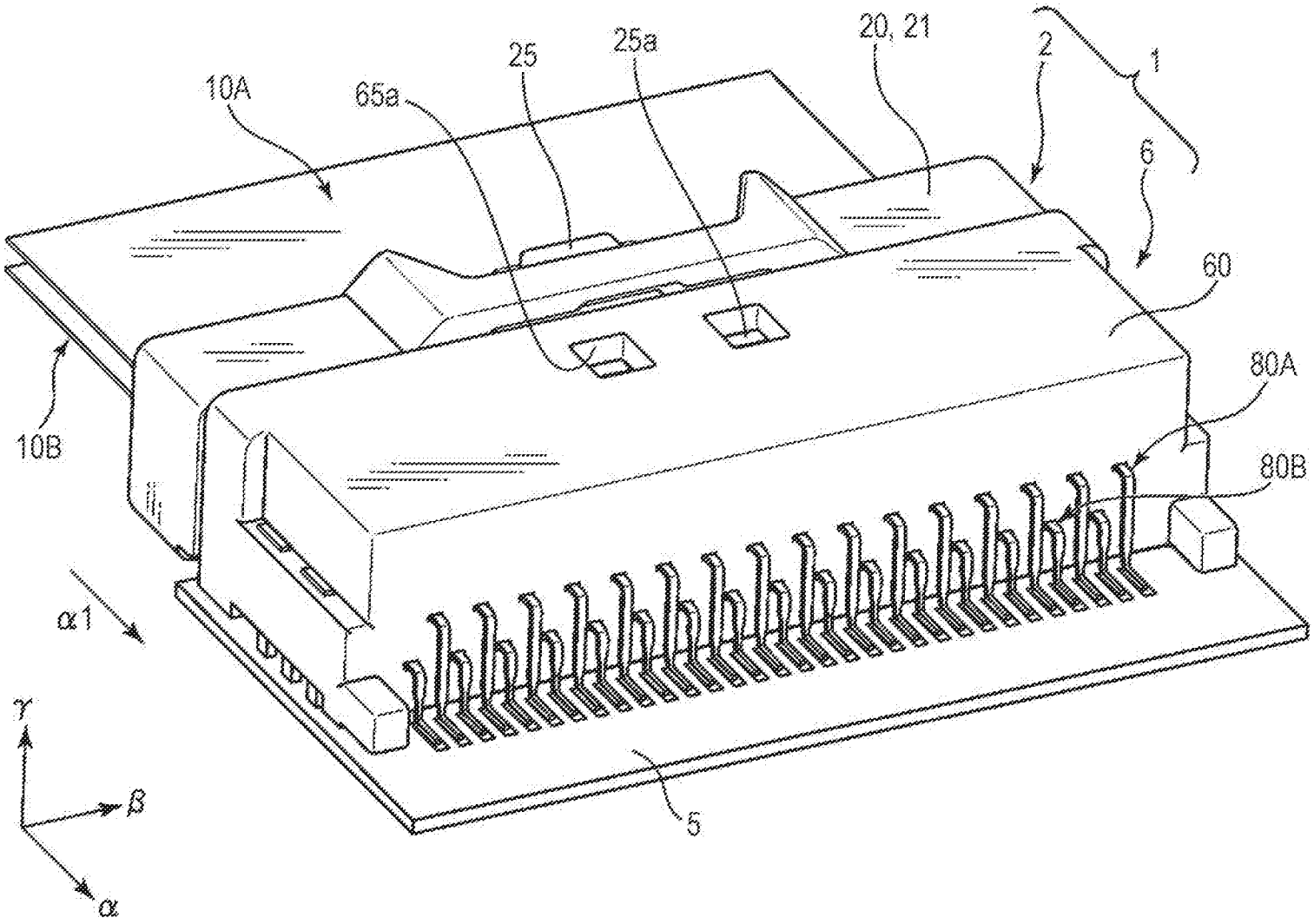
FIG. 3 is a perspective view of the connector and the counterpart connector at an angle different from the angle in FIG. 2.
Figure 4:
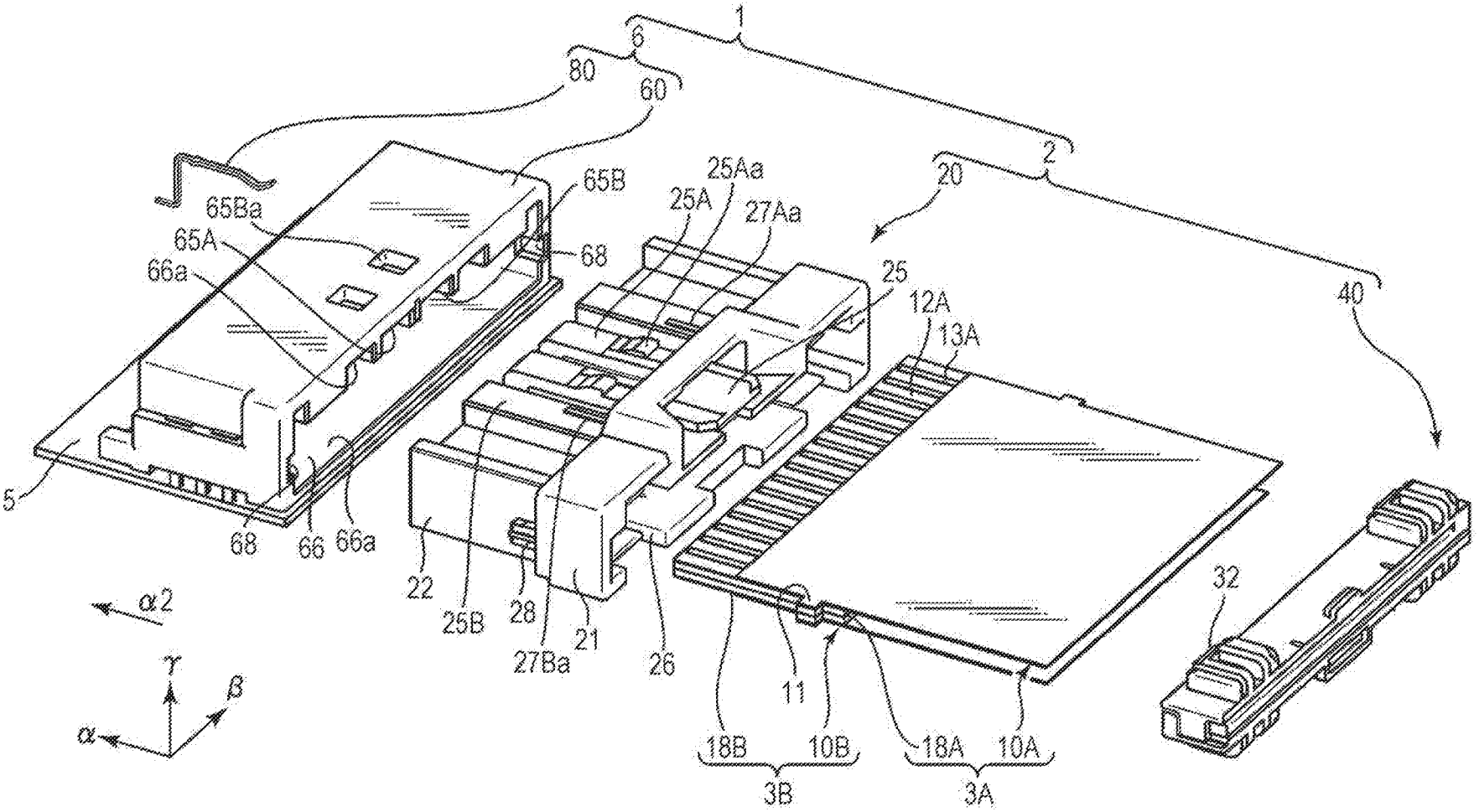
FIG. 4 is an exploded perspective view of the connector and the counterpart connector.

FIG. 1 is a perspective view illustrating a connector device according to a preferred embodiment of the invention, together with peripheral members. A connector device 1 includes a connector 2 and a counterpart connector 6. FIG. 1 illustrates a state before the connector 2 and the counterpart connector 6 are connected to each other. FIGS. 2 and 3 are perspective views illustrating, at different angles, a state after the connector 2 and the counterpart connector 6 are connected to each other. FIG. 4 is an exploded perspective view of the connector 2 and the counterpart connector 6.

The counterpart connector 6 is provided with counterpart inals 80A, 80B in two stages in a thickness direction "γ".

The connector 2 is configured as a cable connector connected to conductive members 10A, 10B. The conductive members 10A, 10B are stacked in the thickness direction "γ". For example, flexible cables or flexible boards can be used as the conductive members 10A, 10B. The illustrated example includes the flexible boards. The two conductive members 10A, 10B enable conductors that perform electrical contact to be disposed on both faces of, for example, a combined body of the flexible boards. For convenience sake, FIG. 1 illustrates a state before the conductive members 10A, 10B are completely attached to the connector 2.

On the other hand, here, a board-mounted connector mounted on a circuit board 5 is described as an example of the counterpart connector 6. The counterpart terminals 80A, 80B of the counterpart connector 6 are arranged in stages, specifically, two stages in the present embodiment corresponding to the two conductive members 10A, 10B of the connector 2 (FIG. 4 illustrates only one terminal 80 of the counterpart connector 6 for convenience sake). Thus, the connector 2 and the counterpart connector 6 enable electrical connection to be performed on both faces of, for example, the combined body of the flexible boards. The connector 2 and the counterpart connector 6 are connected to each other by fitting. However, any method that can connect the connector 2 and the counterpart connector 6 to each other may be employed. The counterpart connector 6 may be configured as a cable connector as with the connector 2.

The connector 2 mainly includes a housing 20 and a holding member 40. The housing 20 is made of resin. The holding member 40 is made of resin and attached to the housing 20. In actual use, a stack 3A including the conductive member 10A and a reinforcing plate 18A and a stack 3B including the conductive member 10B and a reinforcing plate 18B are fixed to the connector 2 through the holding member 40. When the connector 2 and the counterpart connector 6 are connected to each other, an inserted portion 22 on the distal end side of the housing 20 is inserted into an insertion space 66 of the counterpart connector 6. Accordingly, a plurality of conductors 13A disposed on the conductive member 10A and a plurality of conductors 13B disposed on the conductive member 10B can be connected, in a corresponding manner, to the plurality of counterpart terminal 80A and the plurality of counterpart terminal 80B of the counterpart connector 6 on a face of the stack 3A and a face of the stack 3B, in other words, on both faces of a combined body of the stack 3A and the stack 3B.

Figure 5:
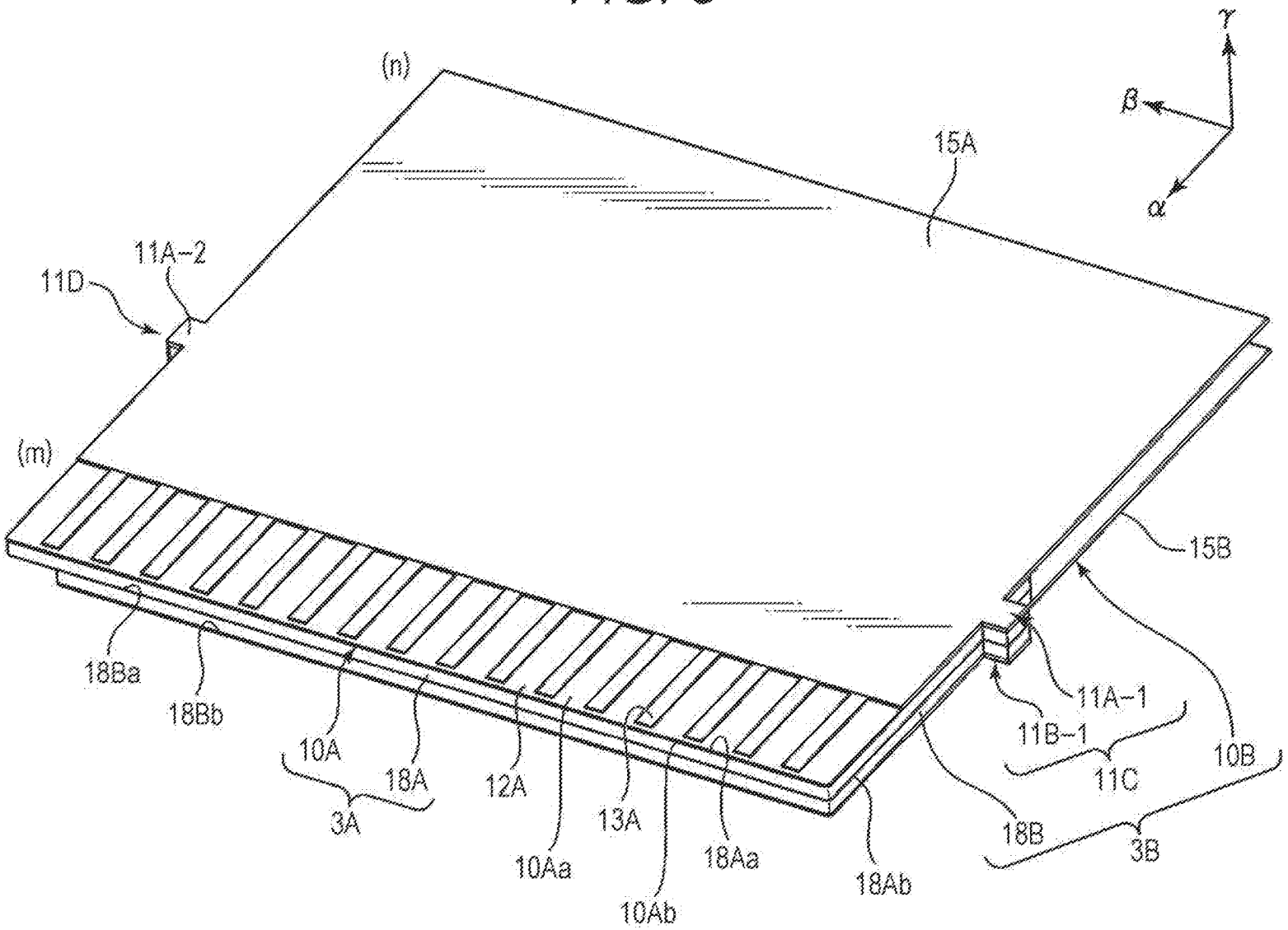
FIG. 5 is a perspective view of stacks.
Figure 6:
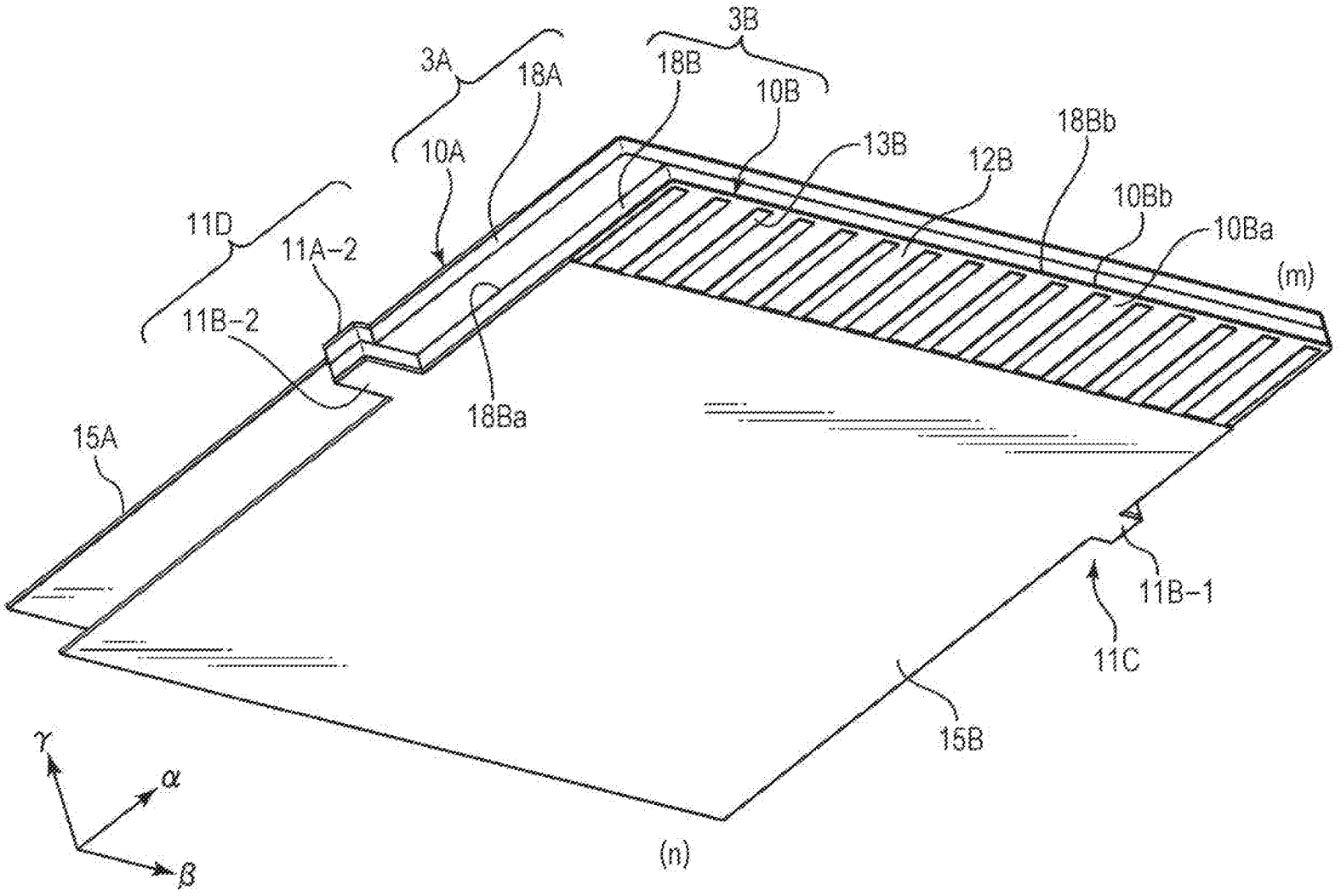
FIG. 6 is a perspective view of the stacks.
Figure 7:
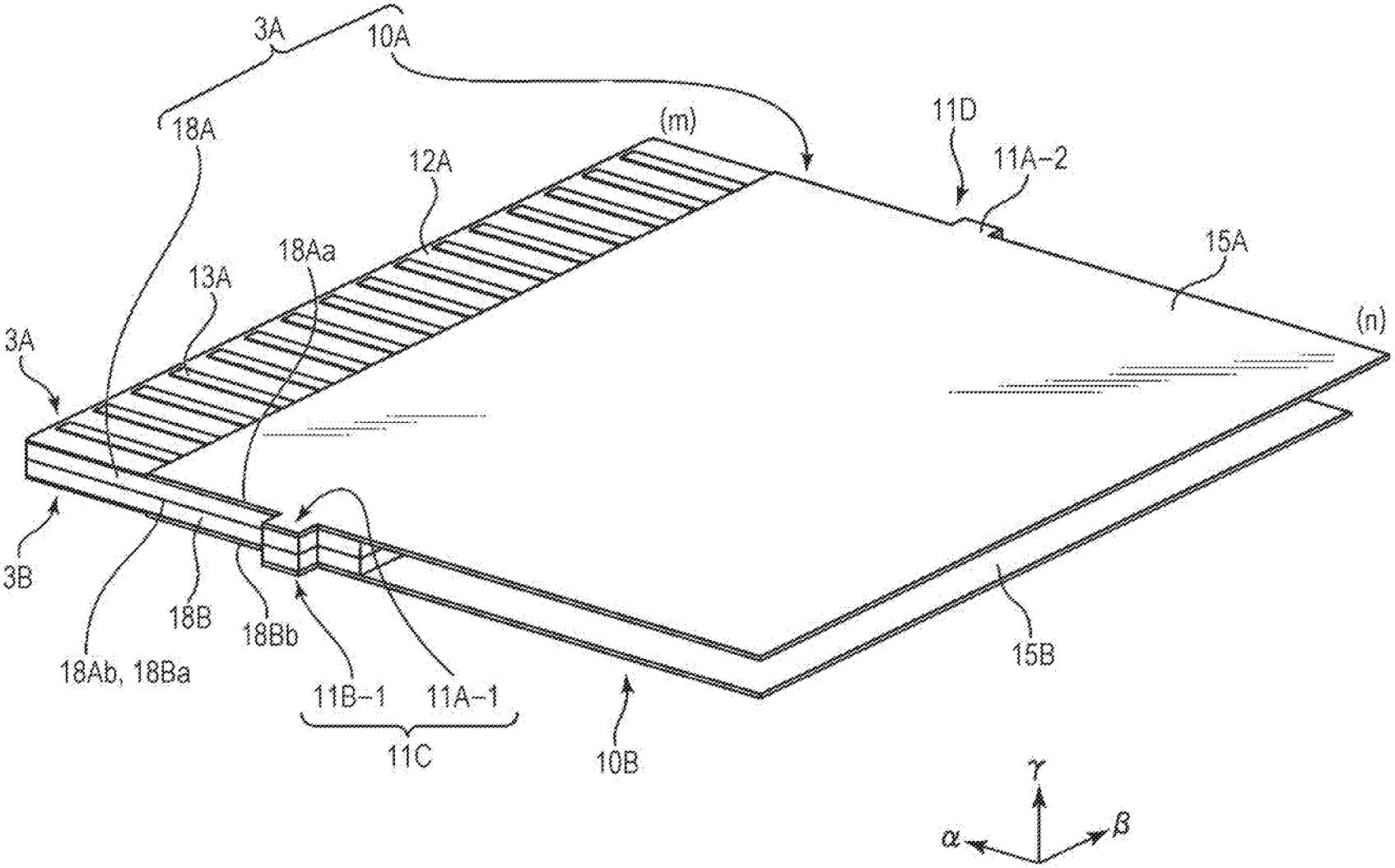
FIG. 7 is a perspective view of the stacks.

FIGS. 5 to 7 are perspective views illustrating, at difference angles, the stacks 3A, 3B. In the present embodiment, to provide the terminals in two stages in the thickness direction "γ", two sets of conductive members 10 and reinforcing plates 18, more specifically, the stack 3A integrally including the conductive member 10A and the reinforcing plate 18A and the stack 3B integrally including the conductive member 10B and the reinforcing plate 18B are provided. The stack 3A, more specifically, the conductive member 10A and the reinforcing plate 18A that constitute the stack 3A, and the stack 3B, more specifically, the conductive member 10B and the reinforcing plate 18B that constitute the stack 3B differ from each other only in size and may be considered to have an identical basic structure. In the connector device 1, the stacks 3A, 3B are used in a stacked state symmetrically in the "γ" direction.

It may be considered that each of the conductive member 10A, 10B has a structure similar to the structure of a known typical flexible board. More specifically, the conductive member 10A (10B) includes an insulating plate-like resin substrate 12A (12B), the plurality of stripe-shaped conductors 13A (13B), and a cover member 15A (15B). The conductors 13A (13B) are arranged adjacent to each other in a width direction "β" on one plate surface of the resin substrate 12A (12B). The cover member 15A (15B) covers the conductors 13A (13B) in such a manner that the conductors 13A (13B) are planarly exposed at a first end side (m) in a length direction "α". The conductive members 10A, 10B are relatively thin and flexible.

The reinforcing plate 18A can partially reinforce the strength of the conductive member 10A, and the reinforcing plate 18B can partially reinforce the strength of the conductive member 10B. The reinforcing plates 18A, 18B are relatively thick plate-like members made of resin. The conductive member 10A (10B) has a first face 10Aa (10Ba) on which the conductors 13A (13B) are exposed and a second face 10Ab (10Bb) opposite to the first face 10Aa (10Ba). The reinforcing plate 18A (18B) is disposed on the second face 10Ab (10Bb). Note that the reinforcing plate 18A(18B) is disposed only in a part of the conductive member 10A (10B) at the first end side (m) in the length direction "α" where the conductors 13A(13B) are arranged and not disposed in the other part. The reinforcing plate 18A (18B) may be fixed to the conductive member 10A (10B) with, for example, an adhesive, or may not be fixed to the conductive member 10A (10B).

When the stacks 3A, 3B are stacked on each other, the stacks 3A, 3B as a whole include, in addition to the set of the conductive member 10A and the reinforcing plate 18A that constitute the stack 3A, the reinforcing plate 18B disposed on a second face 18Ab of the reinforcing plate 18A, the second face 18Ab being opposite to a first face 18Aa on which the conductive member 10A is disposed, and the conductive member 10B disposed on a second face 18Bb of the reinforcing plate 18B, the second face 18Bb being opposite to a first face 18Ba on which the reinforcing plate 18A is disposed. In the conductive member 10B, the reinforcing plate 18B is disposed on the second face 10Bb opposite to the first face 10Ba on which the conductors 13B are arranged adjacent to each other in the width direction "β" and planarly exposed at the first end side (m) in the length direction "α". The dimension of the conductive member 10A and the reinforcing plate 18A in the width direction "β" is longer than the dimension of the conductive member 10B and the reinforcing plate 18B in the width direction "β". Thus, the conductive member 10A and the reinforcing plate 18A partially slightly project from the conductive member 10B and the reinforcing plate 18B in the width direction "β".

The stack 3A includes a pair of locking projections 11A-1, 11A-2 using the conductive member 10A and the reinforcing plate 18A. The locking projections 11A-1, 11A-2 are disposed on respective ends in the width direction "β" and project outward in the width direction "β". The stack 3B includes locking projections 11B-1, 11B-2 using the conductive member 10B and the reinforcing plate 18B. The locking projections 11B-1, 11B-2 are disposed on respective ends in the width direction "β" and project outward in the width direction "β". The locking projections 11A-1 and 11B-1 are stacked on each other and the locking projections 11A-2 and 11B-2 are stacked on each other on the respective sides in the width direction "β". The locking projection 11A-1 of the stack 3A and the locking projection 11B-1 of the stack 3B constitute a locking projection 11C. Similarly, the locking projection 11A-2 of the stack 3A and the locking projection 11B-2 of the stack 3B constitute a locking projection 11D. The locking projections 11C, 11D are mutually slightly displaced in the length direction "α". More specifically, the locking projection 11C is located at a position slightly closer to the connection side (m) in the length direction "α" than the locking projection 11D is. The locking projections 11C, 11D can be locked by predetermined portions of the holding member 40 when the holding member 40 holds the stacks 3A, 3B.

Figure 8:
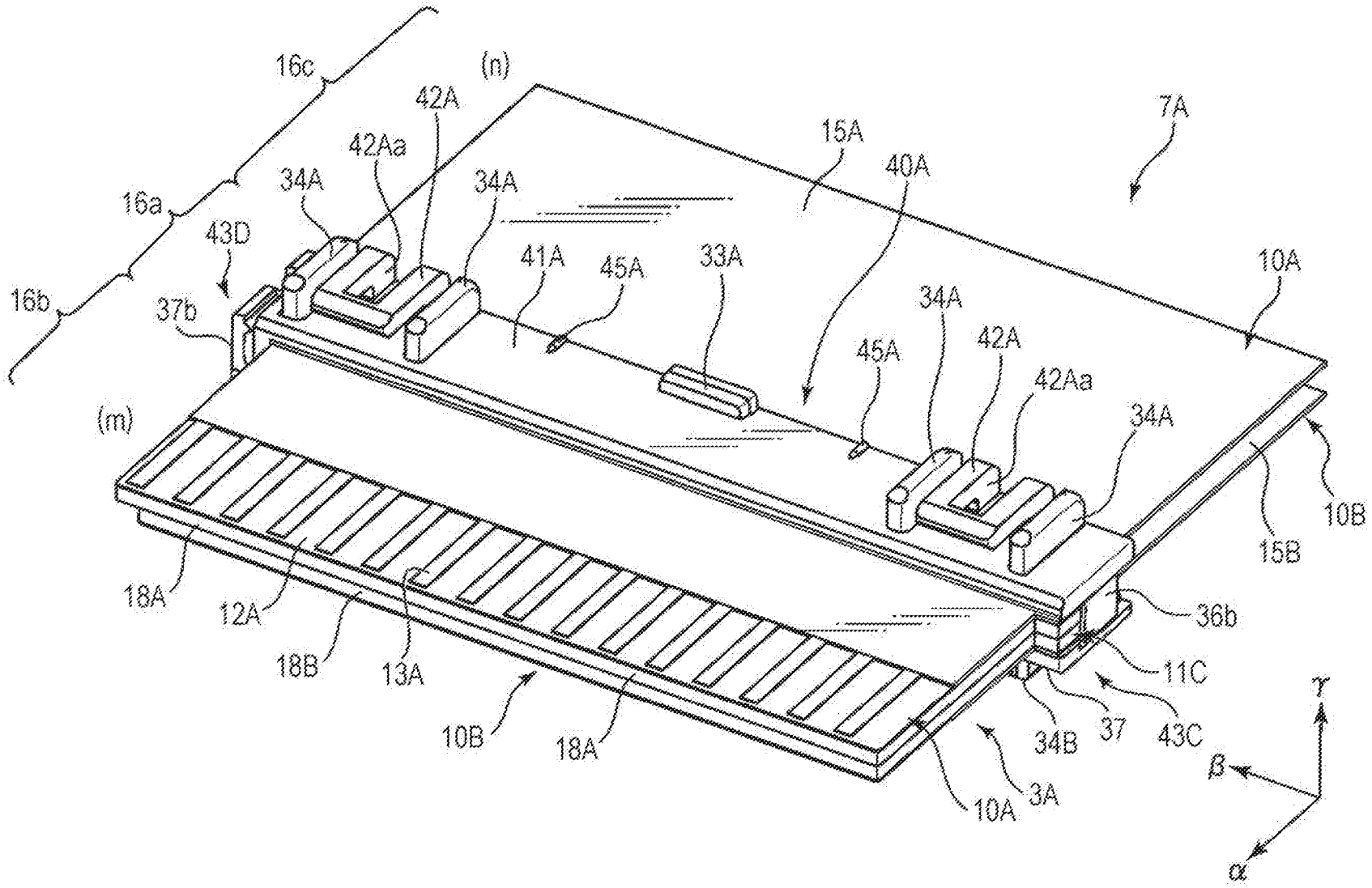
FIG. 8 is a perspective view of a holding member holding the stacks.
Figure 9:
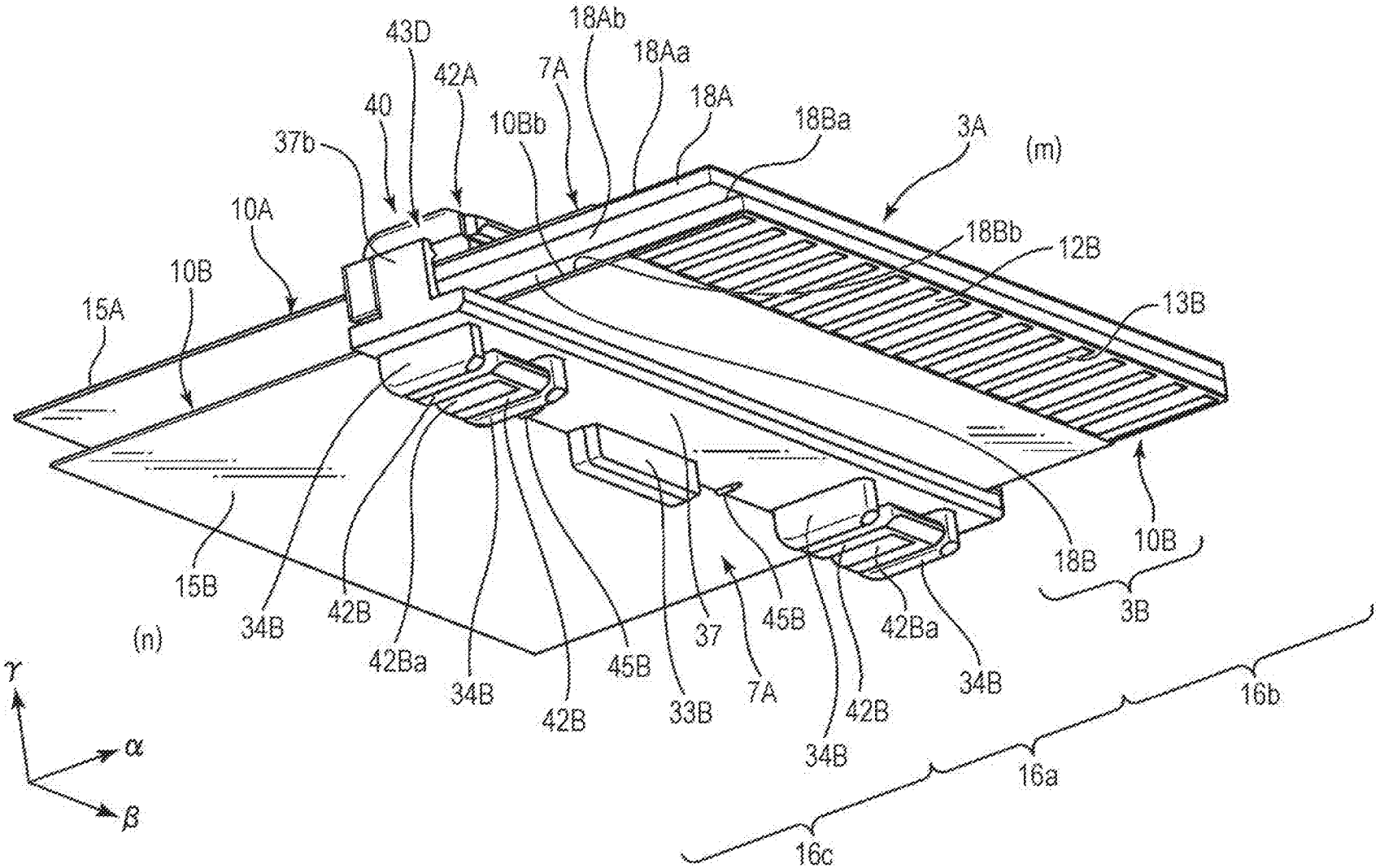
FIG. 9 is a perspective view of the holding member holding the stacks.
Figure 10:
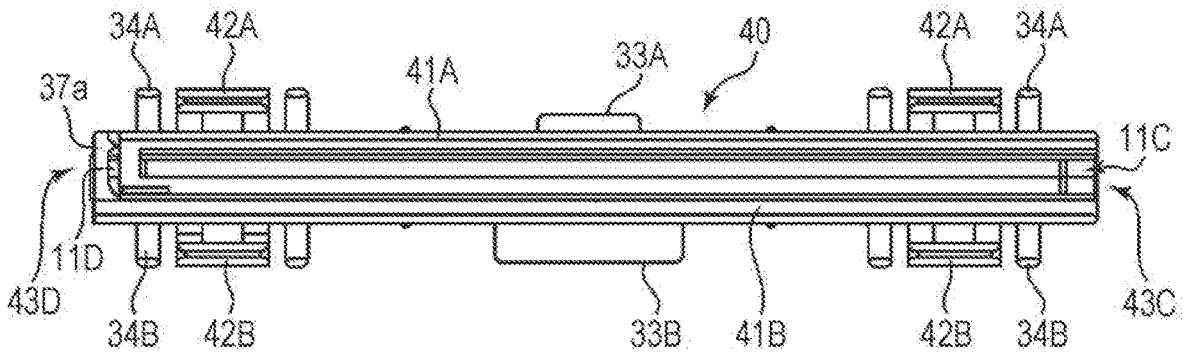
FIG. 10 is a front view of the holding member holding the stacks.
Figure 11:
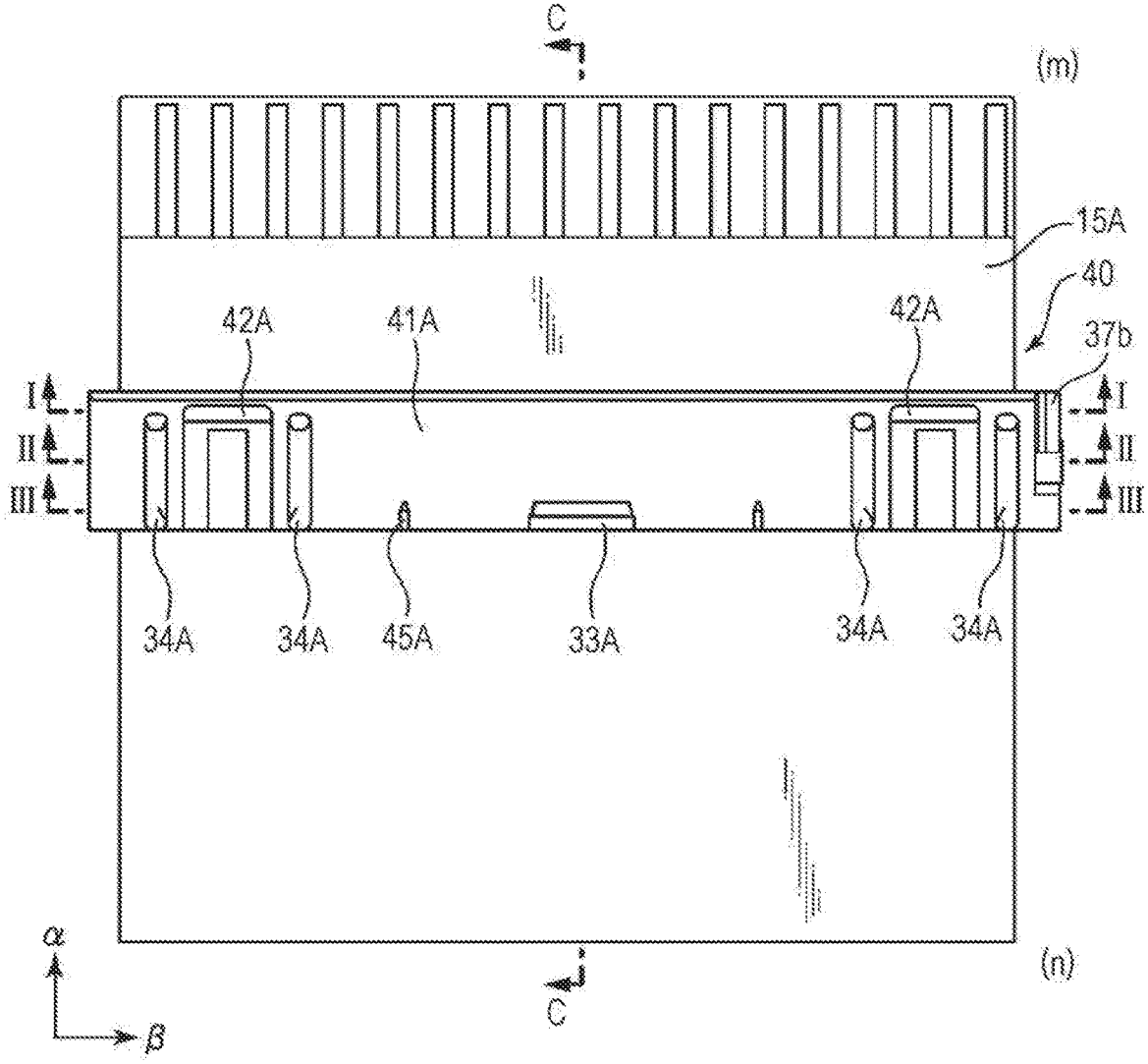
FIG. 11 is a plan view of the holding member holding the stacks.
Figure 12:
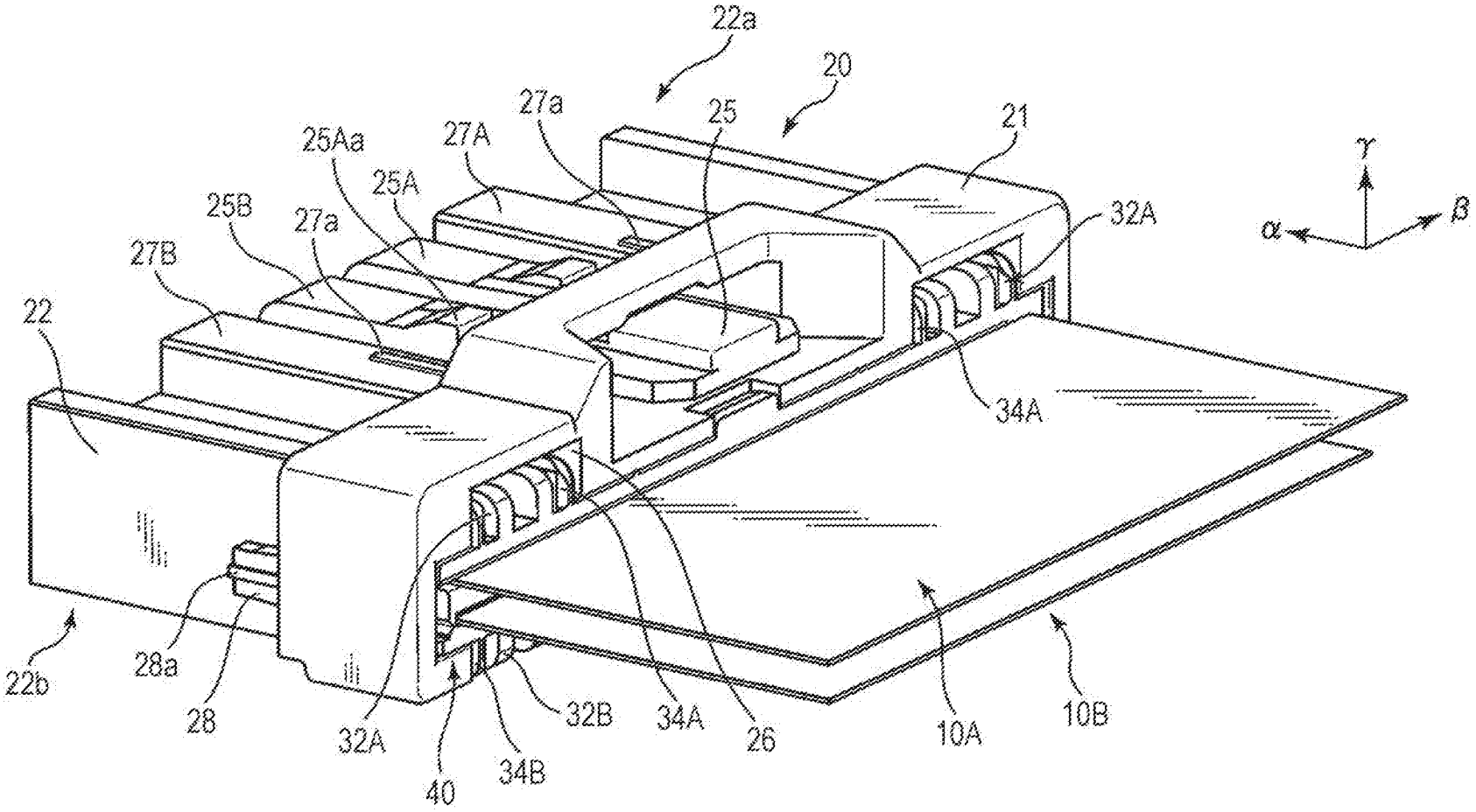
FIG. 12 is a perspective view illustrating a state after the holding member holding the stacks is attached to a housing.
Figure 13:
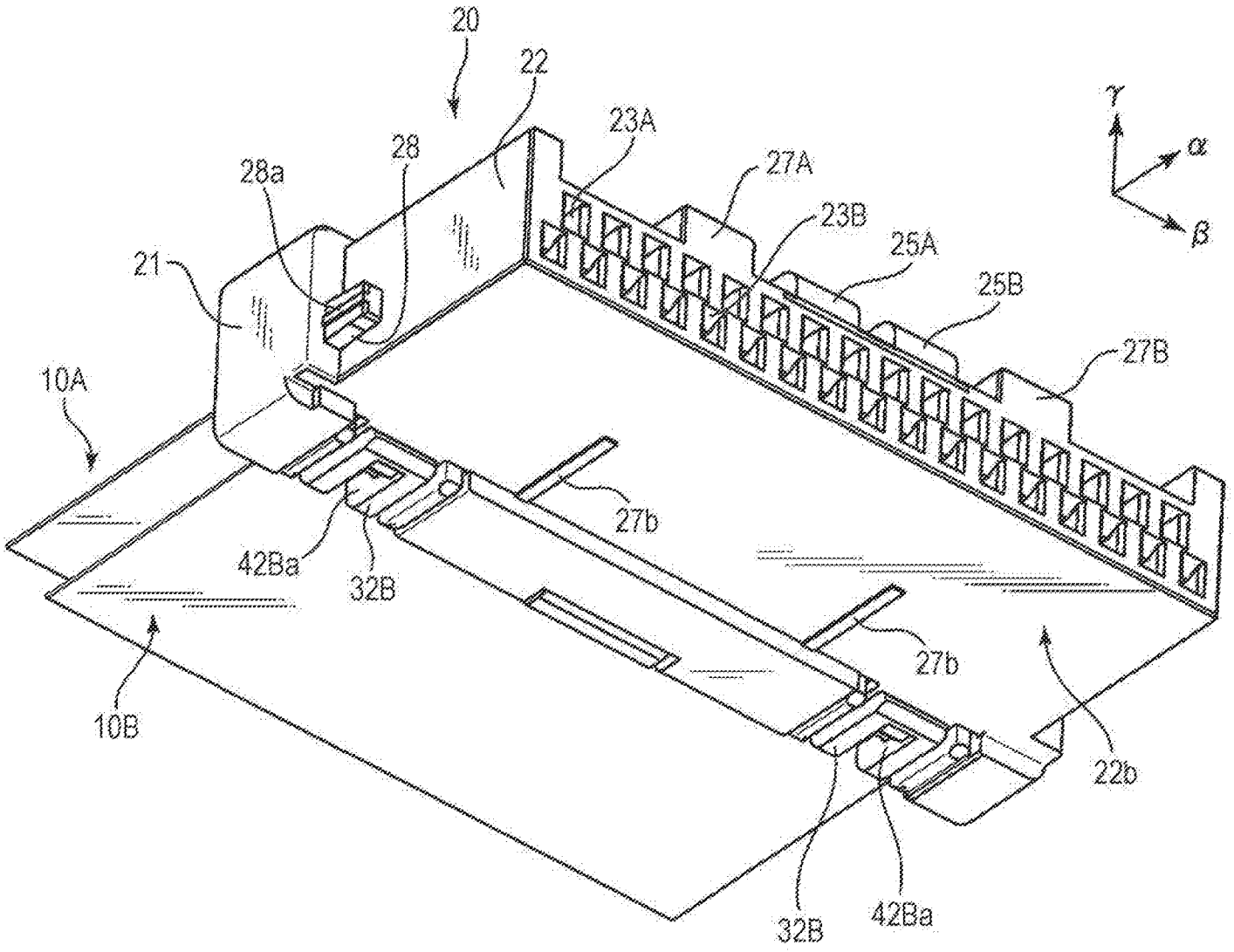
FIG. 13 is a perspective view illustrating the state after the holding member holding the stacks is attached to the housing.

FIGS. 8 and 9 are perspective view illustrating, at different angles, the holding member 40 holding the stacks 3A, 3B. FIG. 10 is a front view of the holding member 40 holding the stacks 3A, 3B, and FIG. 11 is a plan view of the holding member 40 holding the stacks 3A, 3B. FIGS. 12 and 13 are perspective views illustrating, at different angles, a state after the holding member 40 holding the stacks 3A, 3B is attached to the housing 20.

The holding member 40 holding the stacks 3A, 3B is attached to the housing 20. At this time, predetermined portions (tapered projections 24Aa, 24Ba in FIG. 19) of the housing 20 are locked to locking portions 42A, 42B of the holding member 40. The locking portions 42A, 42B are guided to the predetermined portions of the housing 20 by guides 34A, 34B. The guides 34A are disposed at positions that sandwich the locking portion 42A in the width direction "β", and the guides 34B are disposed at positions that sandwich the locking portion 42B in the width direction "β". The stacks 3A, 3B, in particular, the conductors 13A, 13B included in the stacks 3A, 3B can be easily and reliably attached to predetermined positions on the housing 20 by using the holding member 40. When the holding member 40 is attached to the housing 20, the holding member 40 is substantially entirely housed in a housing space 26 of the housing 20 in the length direction "α" corresponding to a connection direction "α1" of connection between the connector 2 and the counterpart connector 6. Thus, the connector device 1A is not upsized.

Figure 14:
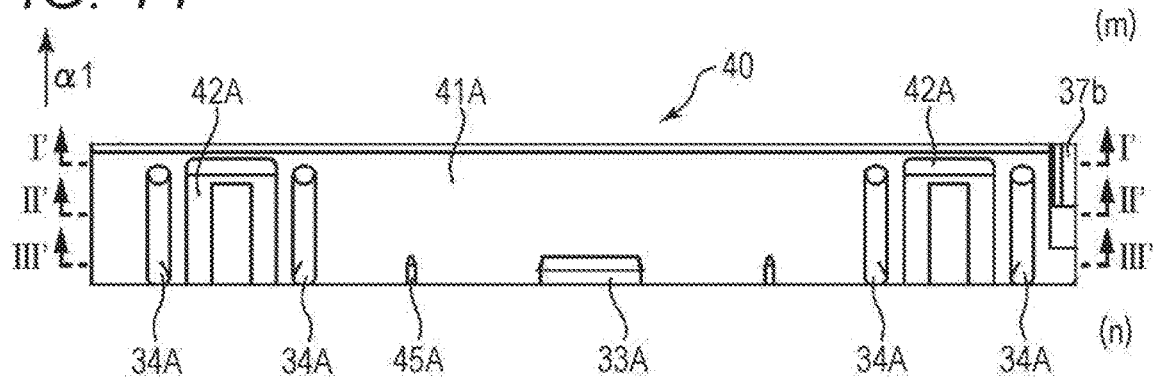
FIG. 14 is a plan view of the holding member.
Figure 15A:
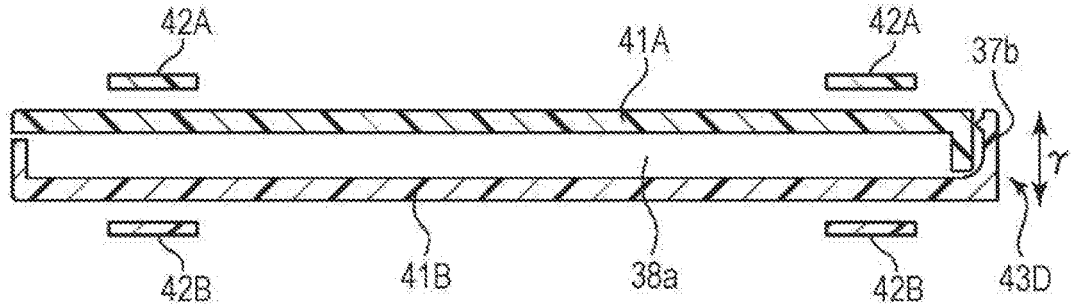
FIGS. 15A to 15C are sectional views respectively taken along line I-I, line II-II, and line III-III in FIG. 14.
Figure 15B:
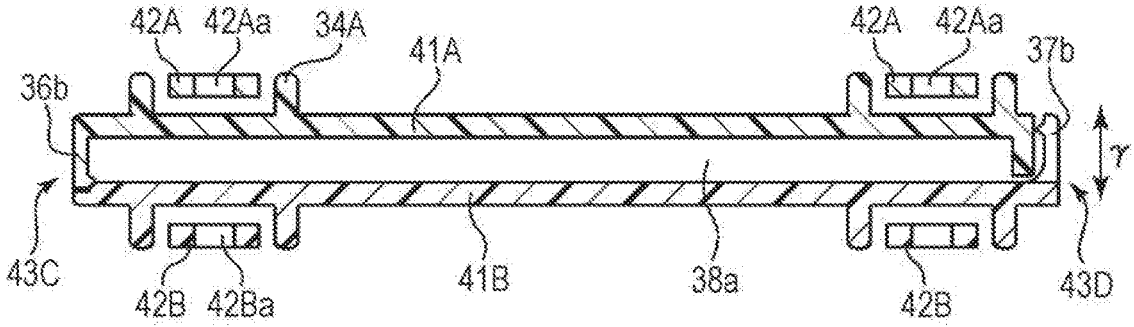
Figure 15C:
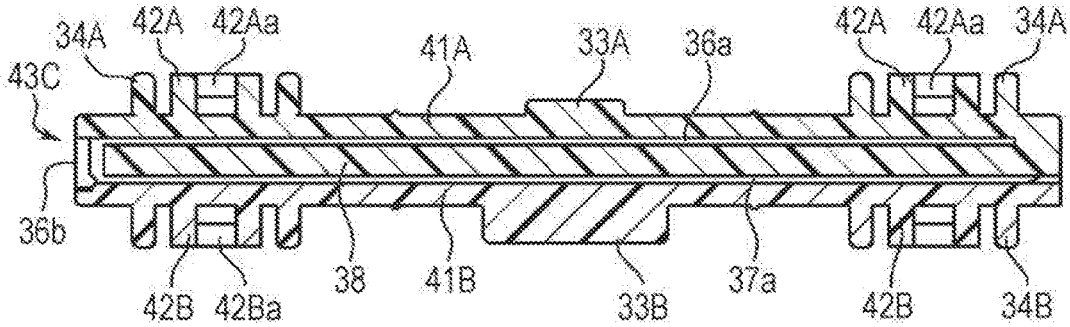

FIG. 14 is a plan view of the holding member 40. FIGS. 15A to 15C are sectional views respectively taken along line I-I, line II-II, and line III-III in FIG. 14.

The holding member 40 mainly includes a first main body 41A, a second main body 41B, and an intermediate member 38. The first main body 41A has a band shape and is located on the upper stage in the thickness direction "γ". The second main body 41B has a band shape and is located on the lower stage in the thickness direction "γ". The intermediate member 38 has a substantially rod shape and is located between the first main body 41A and the second main body 41B in the thickness direction "γ". The first main body 41A, the second main body 41B, and the intermediate member 38 that constitute the holding member 40 extend in the width direction "β".

The first main body 41A includes, in addition to the locking portion 42A and the pair of guides 34A, a relatively small standing plate 33A. The standing plate 33A comes into contact with a predetermined portion of the housing 20 when the holding member 40 is attached to the housing 20 to restrict the insertion of the holding member 40 into the housing 20. Similarly, the second main body 41B includes, in addition to the locking portion 42B and the pair of guides 34B, a relatively large standing plate 33B. The standing plate 33B comes into contact with a predetermined portion of the housing 20 when the holding member 40 is attached to the housing 20 to restrict the insertion of the holding member 40 into the housing 20. Upside-down insertion of the holding member 40 into the housing 20 can be prevented by using the standing plates 33A, 33B.

As obvious from FIG. 15C, the first main body 41A, the second main body 41B, and the intermediate member 38 constitute three layers in an intermediate region in the width direction "β" and are coupled to each other in any parts of the end portions in the width direction "β" to form a substantially Z shape as a whole.

A clearance 36*a* is defined between the intermediate member 38 and the first main body 41A in the thickness direction "γ". Similarly, a clearance 37*a* is defined between the intermediate member 38 and the second main body 41B in the thickness direction "γ". In the lengthdirection "α", the intermediate member 38 is disposed only at the opposite side (n) of the connection side (m) of the first main body 41A and the second main body 41B and not disposed at the connection side (m). Thus, a space 38*a* is formed in a portion that is located between the first main body 41A and the second main body 41B in the thickness direction "γ" and located at the connection side (m) of the first main body 41A and the second main body 41B in the length direction "α".

Figure 16A:
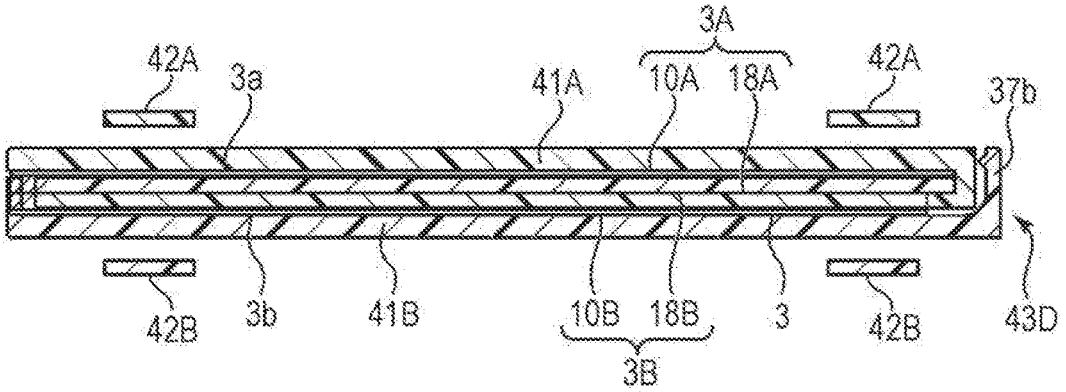
FIGS. 16A to 16C are sectional views respectively taken along line I-I, line II-II, and line III-III in FIG. 11.
Figure 16B:
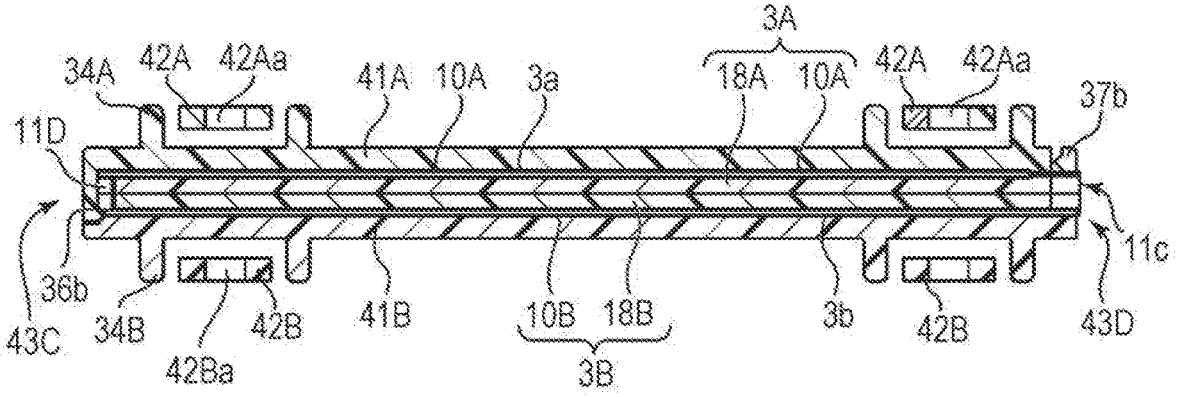
Figure 16C:
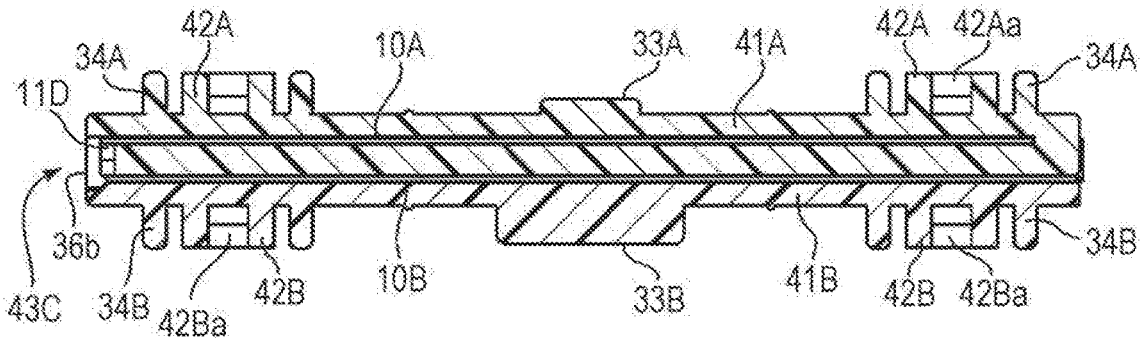
Figure 17:
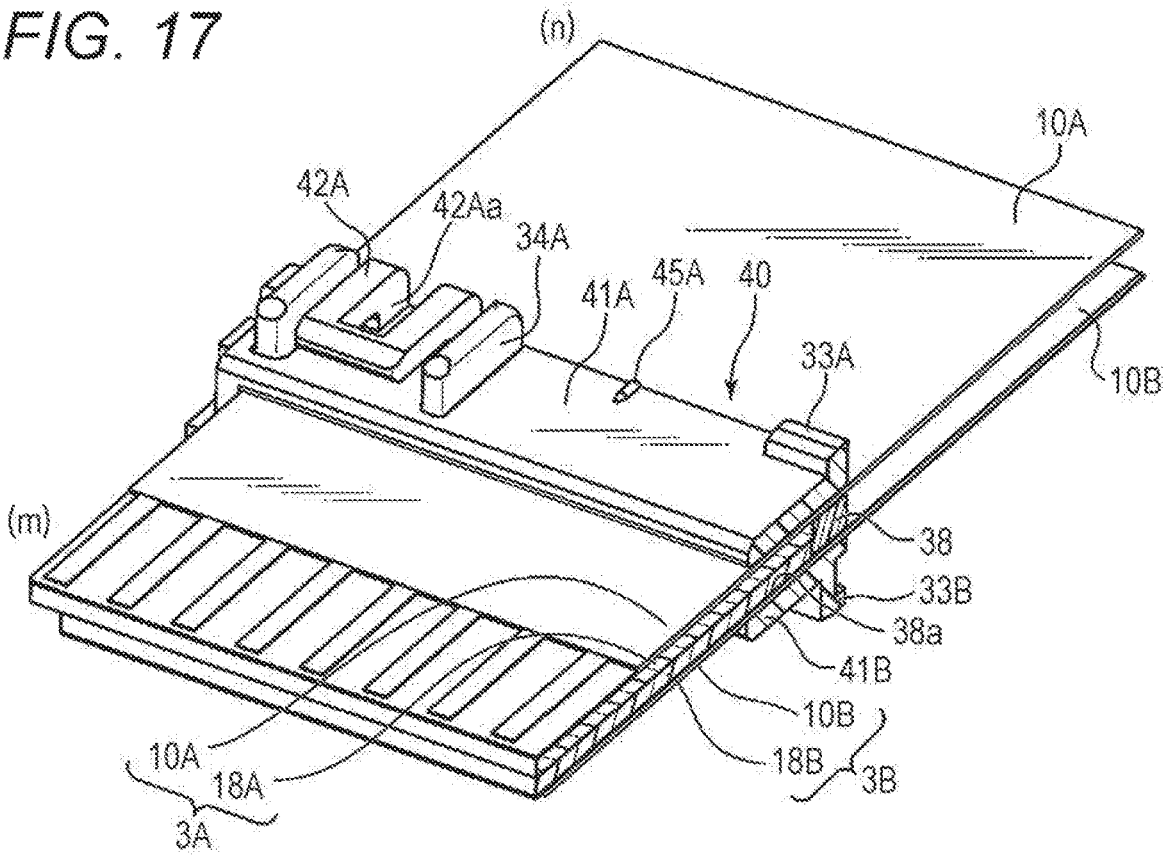
FIG. 17 is a perspective sectional view taken along line C-C in FIG. 11.

FIGS. 16A to 16C are sectional views respectively taken along line line II-II, line II-II, and line III-III in FIG. 11. FIG. 17 is a perspective sectional view taken along line C-C in FIG. 11.

When the stacks 3A, 3B are held by the holding member 40, a part of the conductive member 10A of the stack 3A is placed in a band shape in the clearance 36*a* between the first main body 41A and the intermediate member 38 in the thickness direction "γ". On the other hand, a part of the conductive member 10B of the stack 3B is placed in a band shape in the clearance 37*a* between the second main body 41B and the intermediate member 38 in the thickness direction "γ". When the stacks 3A, 3B are attached to the clearances 36*a*, 37*a*, the holding member 40 is elastically expanded in the thickness direction "γ" to expand the clearance 36*a* and the clearance 37*a*.

When the stacks 3A, 3B area held by the holding member 40, the locking projection 11C is locked to a locking portion 43C. The locking portion 43C includes, for example, a standing portion 36*b*. The standing portion 36*b* is disposed in a standing manner on one end of the first main body 41A toward the second main body 41B. When the stacks 3A, 3B are held by the holding member 40, the locking projection 11C is located at the connection side (m) in the length direction "α" relative to the standing portion 36*b*. Similarly, the locking projection 11D is locked to locking portion 43D. The locking portion 43D is disposed at the side opposite to the locking portion 43C in the width direction "β". The locking portion 43D includes, for example, a standing portion 37*b*. The standing portion 37*b* is disposed in a standing manner on one end of the second main body 41B toward the first main body 41A. When the stacks 3A, 3B are held by the holding member 40, the locking projection 11D is located at the opposite side (n) of the connection side (m) in the length direction "α" relative to the standing portion 37*b*.

The intermediate member 38 is located at the opposite side (n) of the connection side (m) in the length direction "α" relative to the reinforcing plate 18A and the reinforcing plate 18B of the stacks 3A, 3B. Accordingly, the locking projections 11C and 11D and the stacks 3A and 3B are sandwiched between the standing portion 36*b* and the standing portion 37*b* and between the standing portions 36*b*, 37*b* and the intermediate member 38 in the length direction "α". Thus, the stacks 3A, 3B do not come off the holding member 40 in the length direction "α".

When the stacks 3A, 3B are held by the holding member 40, the first main body 41A of the holding member 40 is continuously laid in a band shape in the width direction "β" on the stack 3A, specifically, on one face 3*a* of the stack 3A at an intermediate position between the first end side (m) and a second end side (n) in the length direction "α". On the other hand, the second main body 41B of the holding member 40 is continuously laid in a band shape in the width direction "β" on the stack 3B, specifically, on one face 3*b* of the stack 3B at an intermediate position between the first end side (m) and the second end side (n) in the length direction "α". This mode merely holds the intermediate portions of the stacks 3A, 3B in the length direction "α". Thus, the attaching operation can be simplified. Moreover, in this case, the holding member 40, specifically, the first main body 41A and the second main body 41B of the holding member 40 are laid on both one face and the other face of the combined body of the stacks 3A, 3B. Thus, it is possible to more reliably hold the stacks 3A, 3B.

The holding member 40 holding the stacks 3A, 3B is housed in the housing space 26 (refer to FIG. 4) of the housing 20 and attached to the housing 20. The housing direction with respect to the housing space 26 is identical to the connection direction "α1" when the connector 2 and the counterpart connector 6 are connected to each other. The housing space 26 houses therein only a portion 16*a* held by holding member 40 and a portion 16*b* located at the first end side (m) relative to the portion 16*a* held by the holding member 40 in the conductive members 10A, 10B (refer to FIGS. 8 and 9).

The reinforcing plates 18A, 18B are substantially disposed only in the portion 16*a* held by the holding member 40 and the portion 16*b* located at the first end side (m) relative to the portion 16*a* held by the holding member 40 in the longitudinal direction "α" in the conductive members 10 and not disposed in a portion 16*c* located at the second end side (α2) relative to the portion 16*a* held by the holding member 40. Thus, in the stacks 3A, 3B, the portion 16*c* located at the second end side (α2) relative to the portion 16*a* held by the holding member 40, that is, the portion including only the conductive members 10A, 10B can be relatively easily and freely deformed so as to conform to the internal structure of a casing.

To lock the holding member 40 to the housing 20 when the holding member 40 is housed in the housing space 26, the holding member 40 includes the locking portions 42A, 42B. The locking portions 42A, 42B are disposed on outer faces of the first main body 41A and the second main body 41B of the holding member 40 and project outward. Moreover, to hold, in a sandwiched manner, the holding member 40 in the housing space 26, the holding member 40 includes abutment portions 45A, 45B. The abutment portions 45A, 45B respectively project upward and downward, and abut against predetermined portions of an inner wall of the housing space 26. The influence of vibrations can be effectively reduced by holding, in a sandwiched manner, the holding member 40 in the housing space 26. The abutment portions 45A, 45B have a predetermined length in the length direction "α", and a force is gradually applied between the abutment portions 45A, 45B as the holding member 40 is housed into the housing space 26.

Figure 18:
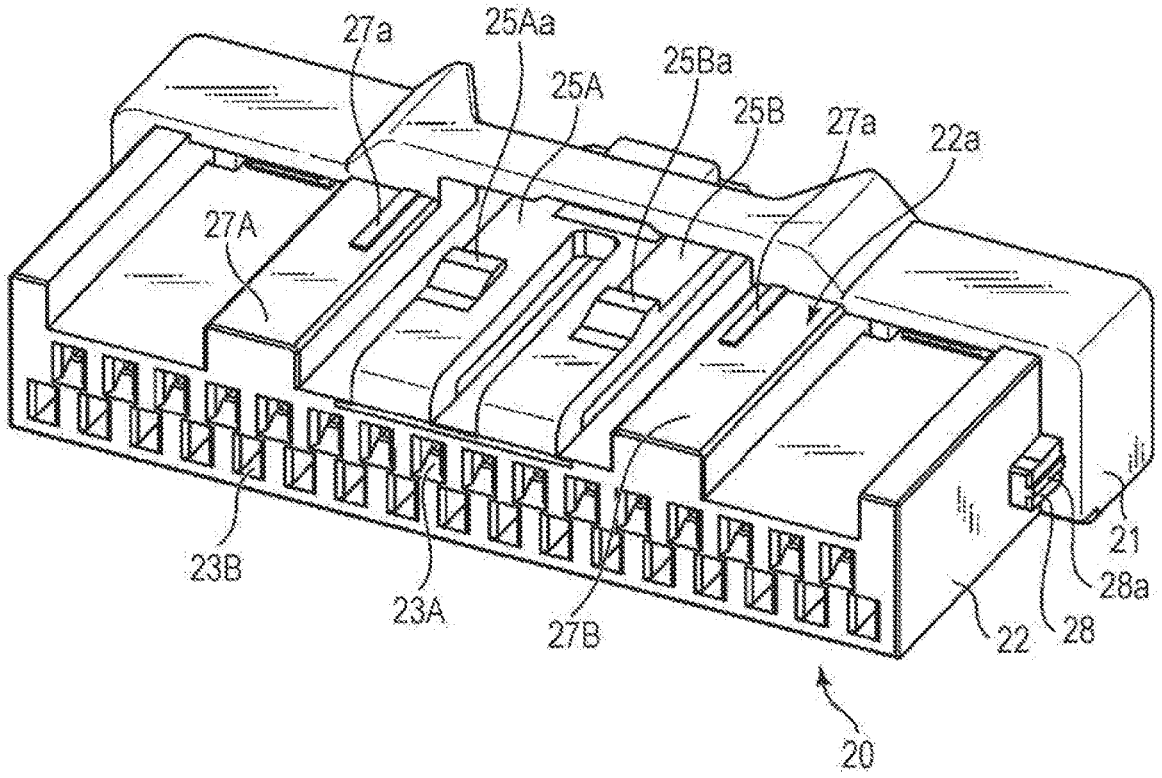
FIG. 18 is a perspective view of the front side of the housing.
Figure 19:
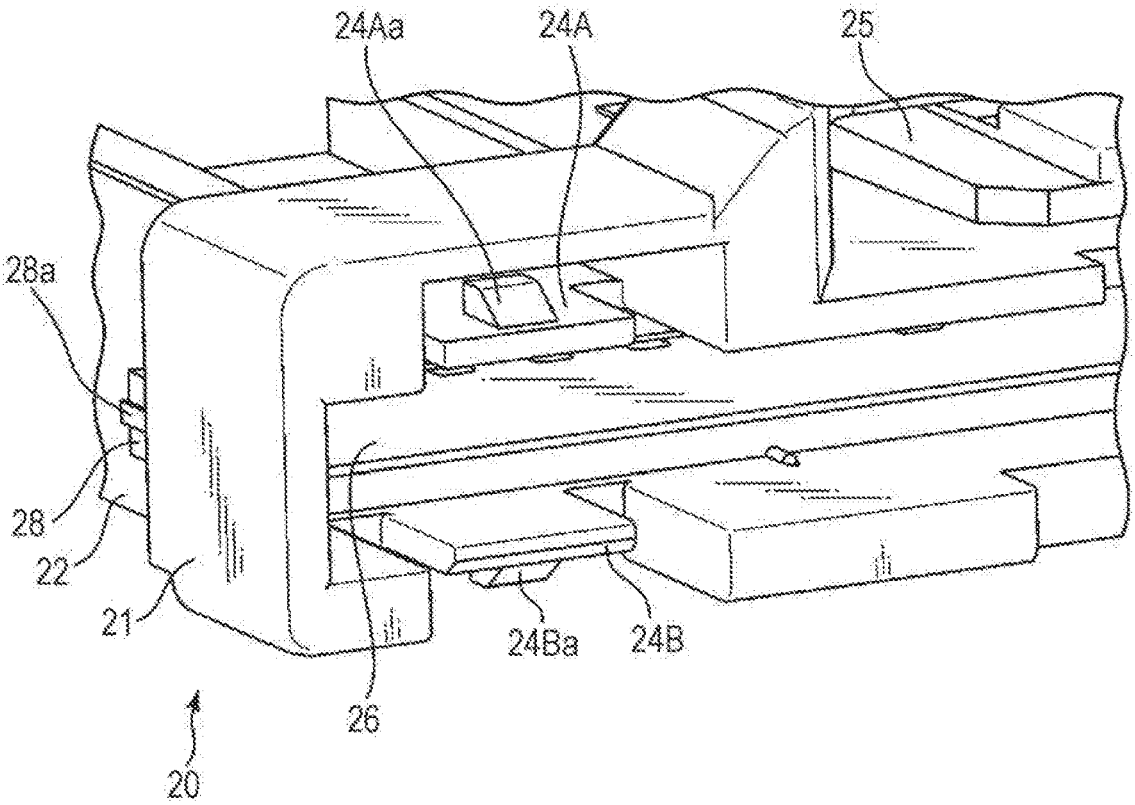
FIG. 19 is a partially enlarged perspective view of the back side of the housing.
Figure 20:
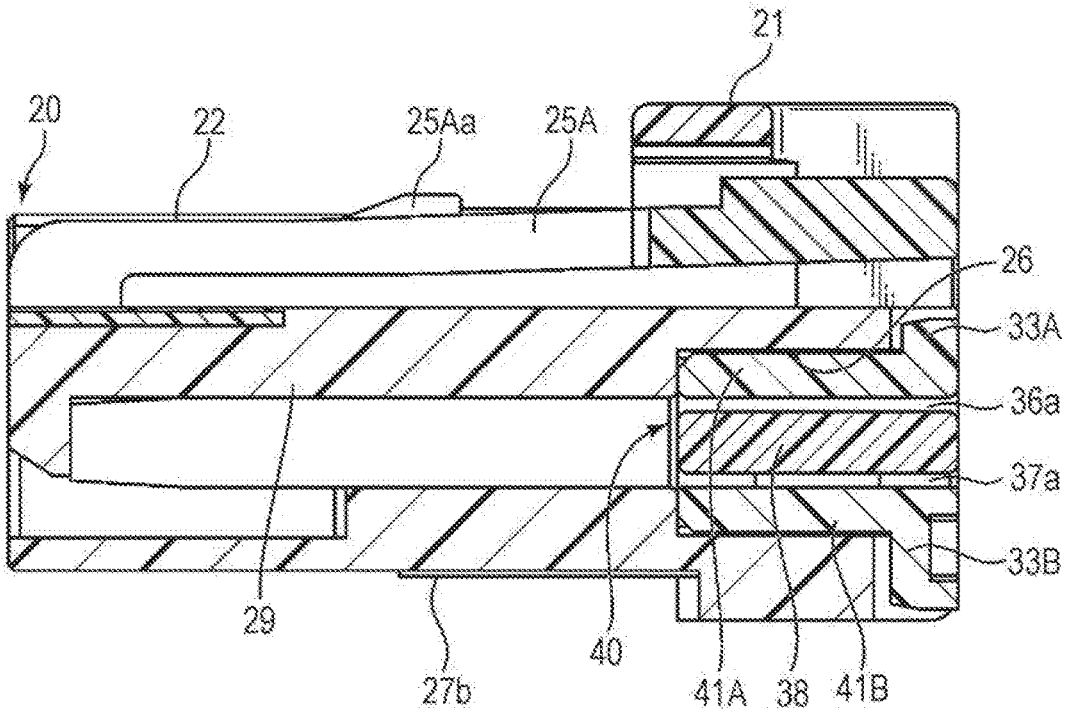
FIG. 20 is a sectional view taken along the center line in FIG. 18 in a state where the holding member is inserted in the housing.

The housing 20 will be described with reference to FIGS. 18 to 20 in addition to FIGS. 1, 2, 4, 12, and 13. FIG. 18 is a perspective view of the front side of the housing 20. FIG. 19 is a partially enlarged perspective view of the back side of the housing 20. FIG. 20 is a sectional view taken along the center line in FIG. 18 in a state where the holding member 40 is inserted in the housing 20. Note that, for convenience sake, FIG. 20 also illustrates the holding member 40.

The housing 20 includes a main body 21 having a substantially frame shape, and the inserted portion 22 extending in the connection direction "α1" of connection with the counterpart connector 6 from the main body 21. When the connector 2 and the counterpart connector 6 are connected to each other, the inserted portion 22 is inserted into the insertion space 66 (refer to, for example, FIG. 22) of the counterpart connector 6.

The main body 21 includes the housing space 26 for housing the holding member 40. The main body 21 includes, near a housing opening of the housing space 26, corresponding locking portions 24A, 24B lockable with the locking portions 42A, 42B of the holding member 40, and, more specifically, includes projections 24Aa, 24Ba lockable with through holes 42Aa, 42Ba of the locking portions 42A, 42B. When the holding member 40 is housed in the housing space 26, the holding member 40 is held, in a sandwiched manner, in the housing space 26 by using the abutment portions 45A, 45B of the holding member 40. Thus, it is possible to effectively reduce the influence of vibrations.

The main body 21 and the inserted portion 22 communicate with each other in the length direction "α" to define the housing space 26 inside the main body 21 and the inserted portion 22. The holding member 40 and the stacks 3A, 3B held by the holding member 40 are housed in the housing space 26. To hold, in a sandwiched manner, the portion (16*b*) located at the first end side (m) relative to the portion 16*a* held by the holding member 40 (refer to FIGS. 8 and 9) in the stacks 3A, 3B, an intermediate wall 29 for holding the upper portions of the stacks 3A, 3B is disposed at the corresponding position in the housing space 26.

The inserted portion 22 includes terminal holes 23A, 23B at the first end side (m) in the length direction "α". The terminal holes 23A, 23B extend in the length direction "α". When the inserted portion 22 is inserted into the insertion space 66 of the counterpart connector 6, the conductors 13A, 13B can come into contact with the counterpart terminals 80A, 80B of the counterpart connector 6 through the terminal holes 23A, 23B.

The inserted portion 22 includes, on an upper central part thereof, a locking piece 25 in a cantilever state. The locking piece 25 branches into two elastic locking pieces 25A, 25B from the first end side (m) toward the other end side (n) in the length direction "α". The elastic locking piece 25A includes a locking projection 25Aa projecting upward at an intermediate position in the length direction "α", and the elastic locking piece 25B includes a locking projection 25Ba projecting upward at an intermediate position in the length direction "α". The connector 2 can be detachably locked to the counterpart connector 6 by using the elastic locking pieces 25A, 25B and the locking projections 25Aa, 25Ba.

The inserted portion 22 includes abutment portions 27*a*, 27*b* on an outer wall thereof, specifically, on a boundary between the main body 21 and the inserted portion 22 in the length direction "α". When the inserted portion 22 is inserted into the insertion space 66 of the counterpart connector 6, the abutment portions 27*a*, 27*b* can abut against an inner wall 66*a* of the insertion space 66. The abutment portions 27*a*, 27*b* project toward the inner wall 66*a* of the insertion space 66 when housed in the insertion space 66 and have a predetermined length in the housing direction "α1". The abutment portions 27*a*, 27*b* make it possible to hold, in a sandwiched manner, the holding member 40 in the housing space 26 to effectively reduce the influence of vibrations.

The abutment portions 27*a*, 27*b* may include a set of a first abutment portion 27*a* disposed on a first face 22*a* of the outer wall of the inserted portion 22 and a second abutment portion 27*b* disposed on a second face 22*b* of the outer wall of the inserted portion 22. The first abutment portion 27*a* and the second abutment portion 27*b* are opposed to each other in the thickness direction "γ" perpendicular to both the length direction "α" and the width direction "β" and disposed at a substantially identical position in the length direction "α" and the width direction "β". Disposing the set of the first abutment portion 27*a* and the second abutment portion 27*b* at symmetrical positions in this manner makes it possible to hold, in a sandwiched manner, the inserted portion 22 in the insertion space 66 to effectively reduce the influence of vibrations. Similarly, abutment portions 28*a* may be disposed in the width direction "β". The abutment portions 28*a* are respectively disposed on positioning projections 28 projecting in the width direction "β".

Figure 21:
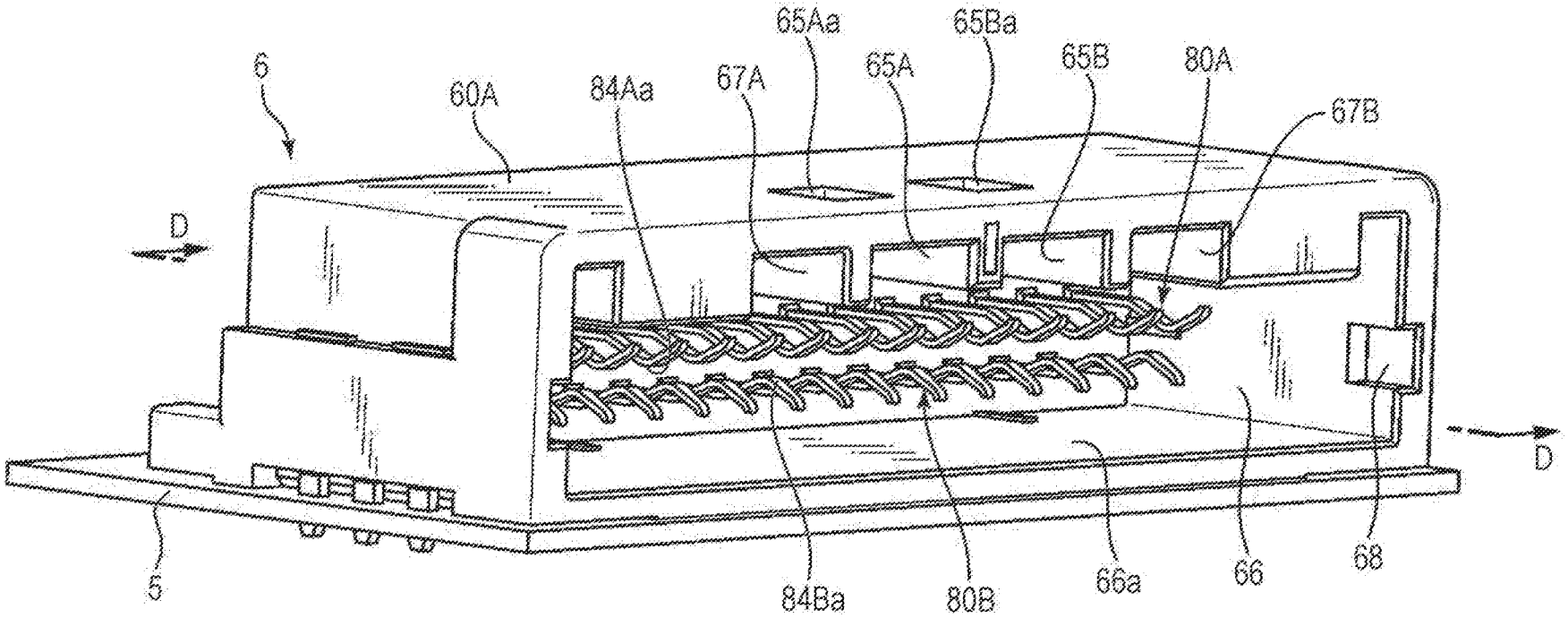
FIG. 21 is a perspective view of the counterpart connector.
Figure 22:
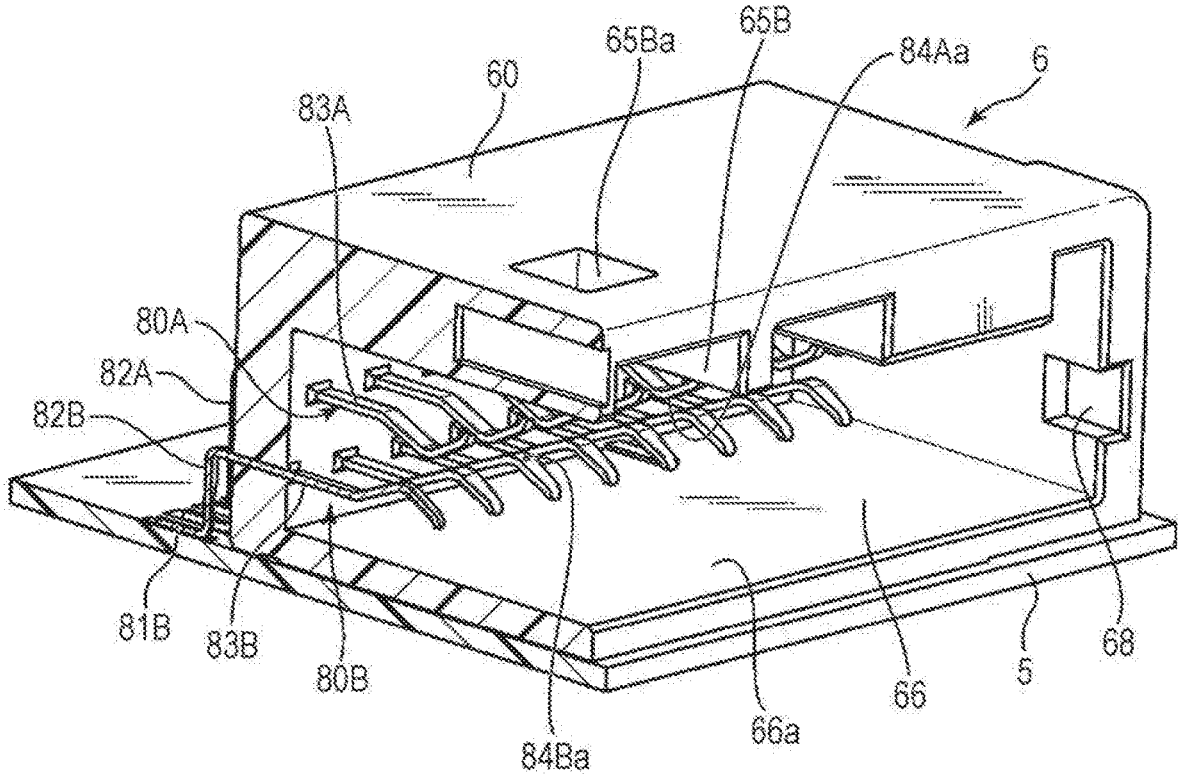
FIG. 22 is a perspective sectional view taken along line D-D in FIG. 21.

FIG. 21 is a perspective view of the counterpart connector 6. FIG. 22 is a perspective sectional view taken along line D-D in FIG. 21. The counterpart connector 6 includes a counterpart housing 60 made of resin and the plurality of counterpart terminals 80A, 80B. The counterpart terminals 80A, 80B are fixed to the counterpart housing 60 by integral molding.

The counterpart housing 60 is a member having a substantially box shape. The counterpart housing 60 includes the insertion space 66 for receiving the inserted portion 22 of the connector 2. The insertion space 66 includes locking grooves 65A, 65B for housing the elastic locking pieces 25A, 25B of the housing 20 of the connector 2. The locking grooves 65A, 65B are disposed on an upper inner wall of the insertion space 66 and extend in the length direction "α". The locking grooves 65A, 65B respectively include locking through holes 65Aa, 65Ba for locking the locking projections 25Aa, 25Ba of the elastic locking pieces 25A, 25B of the connector 2. The locking through holes 65Aa, 65Ba are disposed at intermediate positions in the length direction "α" of the locking grooves 65A, 65B and penetrate an upper wall of the counterpart housing 60. When the inserted portion 22 of the housing 20 of the connector 2 is inserted into the insertion space 66, the locking projections 25Aa, 25Ba are respectively fitted in the through holes 65Aa, 65Ba of the counterpart connector 6 by elastic action of the elastic locking pieces 25A, 25B. Accordingly, the connector 2 is locked to the counterpart connector 6.

The insertion space 66 includes locking grooves 67A, 67B for housing projections 27A, 27B including the abutment portions 27*a*. The locking grooves 67A, 67B are disposed on the upper inner wall of the insertion space 66 and extend in the length direction "α".

The insertion space 66 further includes recesses 68 fittable with the projections 28 of the housing 20 of the connector 2. The recesses are disposed on a side inner wall of the insertion space 66 and extend in length direction "α". When the inserted portion 22 of the housing 20 of the connector 2 is inserted into the insertion space 66, the projections 28 are fitted in the recesses 68 of the counterpart connector 6, and the connector 2 is positioned at a predetermined position in the counterpart connector 6.

The counterpart terminals 80A, 80B are arranged in stages in the thickness direction "γ". The first counterpart terminals 80A are arranged in the upper stage and included in a first terminal group. The second counterpart terminals 80B are arranged in the lower stage and included in a second terminal group. The first counterpart terminals 80A and the second counterpart terminals 80B are mutually displaced in the width direction "β" and have substantially no overlap in the thickness direction "γ".

In the counterpart housing 60, the counterpart terminals 80A are arranged adjacent to each other in the width direction "β", and the counterpart terminals 80B are arranged adjacent to each other in the width direction "β". The counterpart terminal 80A includes a fixed portion 81A, a leg portion 82A, and an elastic piece 84A. The fixed portion 81A is fixed to the circuit board 5 by, for example, reflow. The leg portion 82A is disposed in a standing manner on the fixed portion 81A. The elastic piece 84A extends in the length direction "α" in the insertion space 66. The counterpart terminal 80A is molded and fixed to the counterpart housing 60 in a part of a molded portion 83A located between the leg portion 82A and the elastic piece 84A. The counterpart terminal 80B has a structure similar to the structure of the counterpart terminal 80A. A leg portion 82B of the counterpart terminal 80B is shorter than the leg portion 82A of the counterpart terminal 80A. The elastic pieces 84A, 84B respectively include elastic contact surfaces 85A, 85B. The elastic contact surfaces 85A, 85B can respectively come into elastic contact with the conductors 13A, 13B of the conductive members 10A, 10B in the length direction "α" when the housing 20 of the connector 2 is inserted into the insertion space 66. The elastic contact surfaces 85A, 85B respectively include contact portions 84Aa, 84Ba at one end side. The contact portions 84Aa, 84Ba are bent in any direction intersecting the length direction "α", for example, the thickness direction "γ". The contact portions 84Aa, 84Ba are bent in a dogleg shape to opposite sides so that the contact portions 84Aa, 84Ba can respectively come into contact with the conductors 13A, 13B included in the stack 3A, 3B.

The present disclosure is not limited to the above embodiment and can be variously modified.

For example, in the embodiment described above, the holding member is continuously laid in a band shape in the width direction on both the one face and the other face of the combined body of the stacks when the holding member holds the stacks. However, the holding member may be laid on only either the one face or the other face of the stacked body of the stacks.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector comprising:

a housing; and a holding member attached to the housing, the holding member being configured to hold a stack of a first conductive member and a first reinforcing plate, the first reinforcing plate being disposed on a second face of the first conductive member, the second face being opposite to a first face on which a plurality of conductors is arranged adjacent to each other in a width direction and planarly exposed at a first end side in a length direction, the holding member being laid in a band shape in the width direction on the stack at an intermediate position between the first end side and a second end side in the length direction, the stack further including a second reinforcing plate and a second conductive member, the second reinforcing plate being disposed on a second face of the first reinforcing plate, the second face being opposite to a first face on which the first conductive member is disposed, the second conductive member being disposed on a second face of the second reinforcing plate, the second face being opposite to a first face on which the first reinforcing plate is disposed, and the second reinforcing plate being disposed on a second face of the second conductive member, the second face being opposite to a first face on which a plurality of conductors is arranged adjacent to each other in the width direction and planarly exposed at the first end side in the length direction.

2. The connector according to claim 1, wherein the stack includes a locking projection on an end in the width direction, the locking projection projecting outward in the width direction, and the holding member includes a locking portion configured to lock the locking projection.

3. The connector according to claim 1, wherein, when the holding member holds the stack, the holding member is continuously laid in a band shape in the width direction on only either a first face or a second face of the stack, or continuously laid in a band shape in the width direction on both the first face and the second face of the stack.

4. The connector according to claim 1, wherein, when the holding member is attached to the housing, the holding member is substantially entirely housed in a housing space of the housing in the length direction.

5. The connector according to claim 1, wherein, when the holding member holding the stack is attached to the housing, a first portion of the first conductive member, the first portion being held by the holding member, and a second portion of the first conductive member, the second portion being located at the first end side in the length direction relative to the first portion held by the holding member are housed in a housing space of the housing.

6. The connector according to claim 1, wherein the first reinforcing plate is disposed in a first portion of the first conductive member, the first portion being held by the holding member, and a second portion of the first conductive member, the second portion being located at the first end side in the length direction relative to the first portion held by the holding member.

7. The connector according to claim 6, wherein the first reinforcing plate is not disposed in a third portion of the first conductive member, the third portion being located at the second end side in the length direction relative to the first portion held by the holding member.

8. The connector according to claim 1, wherein a direction of connecting the connector to a counterpart connector is identical to a direction of housing the holding member into a housing space of the housing.

9. The connector according to claim 1, wherein the housing insertable into an insertion space of a counterpart connector includes an abutment portion on an outer wall of the housing, the abutment portion projecting toward an inner wall of the insertion space and abatable against the inner wall of the insertion space when at least a part of the housing is inserted into the insertion space.

10. The connector according to claim 9, wherein the abutment portion includes a set of a first abutment portion disposed on a first face of the outer wall of the housing and a second abutment portion disposed on a second face of the outer wall of the housing, and the first abutment portion and the second abutment portion are opposed to each other in a thickness direction perpendicular to both the width direction and the length direction and disposed at a substantially identical position in the length direction and the width direction.

11. The connector according to claim 1, wherein a counterpart connector connectable with the connector includes:

a plurality of counterpart terminals arranged adjacent to each other in the width direction; and a counterpart housing integrally molded with the counterpart terminals, and each of the counterpart terminals includes an elastic contact surface elastically contactable with a corresponding one of the conductors of the first conductive member in the length direction when the housing of the connector is inserted into an insertion space of the counterpart housing of the counterpart connector, and the elastic contact surface is bent in any direction intersecting the length direction in a portion contactable with the corresponding conductor of the first conductive member of the connector.

12. The connector according to claim 11, wherein the elastic contact surface is bent in the thickness direction.

13. The connector according to claim 11, wherein the counterpart terminals are arranged in stages in the thickness direction, the counterpart terminals include first counterpart terminals and second counterpart terminals, the first counterpart terminals being arranged in a first stage and included in a first terminal group, the second counterpart terminals being arranged in a second stage and included in a second terminal group, and the first counterpart terminals and the second counterpart terminals are mutually displaced in the width direction and have substantially no overlap in the thickness direction.

14. The counterpart connector according to claim 11.

15. The connector according to claim 14, wherein the counterpart connector is a board-mounted connector.

16. A connector device comprising:

the connector according to claim 1; and a counterpart connector.

* * * * *